US006003279A

United States Patent [19]

Schneider

[11] Patent Number: 6,003,279

[45] Date of Patent: Dec. 21, 1999

[54] SUNROOM ENCLOSURE

[76] Inventor: Dale P. Schneider, 310 Deerwood La., Brentwood, Tenn. 37027

[21] Appl. No.: 09/133,682

[22] Filed: Aug. 13, 1998

[51] Int. Cl.[6] ..... E04C 2/34

[52] U.S. Cl. ..... 52/481.1; 52/282.1; 52/731.2; 52/731.4; 52/731.5; 52/732.3; 52/733.1; 49/DIG. 2; 403/230; 403/231; 403/354; 403/364

[58] Field of Search ..... 52/731.2, 731.4, 52/731.5, 732.3, 733.1, 282.1, 481.1; 403/354, 364, 230, 231; 49/DIG. 2

[56] References Cited

U.S. PATENT DOCUMENTS

| | | | |
|---|---|---|---|
| D. 327,744 | 7/1992 | Francis . | |
| 2,947,040 | 8/1960 | Schultz . | |
| 3,055,461 | 9/1962 | De Ridder . | |
| 3,096,861 | 7/1963 | Frick et al. . | |
| 3,310,926 | 3/1967 | Brandreth et al. | 52/582 |
| 3,340,657 | 9/1967 | Thomas . | |
| 3,345,794 | 10/1967 | Proud . | |
| 3,562,992 | 2/1971 | Kinsey . | |
| 3,733,756 | 5/1973 | Butler . | |
| 3,760,544 | 9/1973 | Hawes et al. . | |
| 3,805,470 | 4/1974 | Brown . | |
| 3,848,387 | 11/1974 | Hafner | 52/735 |
| 3,952,461 | 4/1976 | Kinsey . | |
| 3,978,629 | 9/1976 | Echols, Sr. . | |
| 4,040,219 | 8/1977 | Budich . | |
| 4,057,941 | 11/1977 | Schwartz . | |
| 4,069,627 | 1/1978 | Pegg . | |
| 4,110,942 | 9/1978 | Slocomb, Jr. . | |
| 4,167,838 | 9/1979 | Metheny . | |
| 4,261,144 | 4/1981 | Rizzo | 52/63 |
| 4,583,333 | 4/1986 | Minter . | |
| 4,594,828 | 6/1986 | Taylor . | |
| 4,601,139 | 7/1986 | Esposito . | |
| 4,724,646 | 2/1988 | Meyers . | |
| 4,745,723 | 5/1988 | Esposito . | |
| 4,765,102 | 8/1988 | Kuchem . | |
| 4,773,193 | 9/1988 | Biebuyck et al. . | |
| 4,796,395 | 1/1989 | Israel . | |
| 4,884,376 | 12/1989 | DeBlock et al. . | |
| 4,903,455 | 2/1990 | Veazey . | |
| 4,918,882 | 4/1990 | Funk . | |
| 5,003,733 | 4/1991 | Strobl, Jr. et al. . | |
| 5,007,215 | 4/1991 | Minter . | |
| 5,046,791 | 9/1991 | Kooiman . | |
| 5,090,164 | 2/1992 | Mische . | |
| 5,125,207 | 6/1992 | Strobl, Jr. et al. . | |
| 5,197,253 | 3/1993 | Johnson . | |
| 5,293,728 | 3/1994 | Christopher et al. . | |
| 5,325,647 | 7/1994 | Forry et al. . | |
| 5,363,615 | 11/1994 | Christopher et al. . | |
| 5,394,664 | 3/1995 | Nowell . | |
| 5,555,681 | 9/1996 | Cawthon . | |
| 5,560,155 | 10/1996 | Back . | |
| 5,568,707 | 10/1996 | Ishikawa et al. . | |
| 5,608,997 | 3/1997 | Mahowich . | |
| 5,771,640 | 6/1998 | Back . | |

FOREIGN PATENT DOCUMENTS

| | | |
|---|---|---|
| 459516 | 9/1968 | Switzerland . |

OTHER PUBLICATIONS

Continental Vinyl Products, Inc., "First Came Vinyl Siding . . . " advertisement, appearing in Fenestration Magazine, Jan./Feb., 1997 issue.

Continental Vinyl Products, Inc., "First Came Vinyl Siding . . . " advertisement, sppearing in Fenestration Magazine, Sep., 1997 issue.

*Primary Examiner*—Christopher T. Kent
*Assistant Examiner*—Nkeisha J. Maddox
*Attorney, Agent, or Firm*—Shanks & Herbert

[57] ABSTRACT

The invention relates to a thermally efficient and low maintenance enclosed structure, such as a sunroom, made from a framework of joined structural members, thermally insulating kick panels, windows, optional door assembly, optional skylights, and a roof. The structural members include reinforced and non-reinforced polyvinyl chloride extrusions. The structural members are joined together at joints using hardware which cannot be seen from inside or outside the enclosure thereby enhancing the aesthetic appeal of the enclosure. Machines for making the enclosure from a small number of extruded profiles are also described.

23 Claims, 30 Drawing Sheets

SUNROOM ENCLOSURE

TECHNICAL FIELD AND INDUSTRIAL APPLICABILITY OF THE INVENTION

This invention relates to enclosed structures. More specifically, the invention relates to sunrooms or patio enclosures constructed from a framework of reinforced plastic members, insulating wall panels, windows, and a roof. The invention also relates to methods and machines for construction and manufacturing of the enclosed structure.

BACKGROUND OF THE INVENTION

Sunrooms are not new to the building industry. When adding onto or remodeling an existing home or other structure, many people turn to a sunroom or patio enclosure. Such rooms are relatively easy for trained technicians to construct and are inexpensive when compared to other improvements that can be made to a home, such as remodeled bathrooms or kitchens. Sunrooms have traditionally been constructed of an aluminum frame with windows or glass sections. Aluminum sunrooms are shaped with vertical walls that have a curved transition to the roof, although most may have a marque roof or gable type roof.

Aluminum framed rooms constructed in this manner, however, have several disadvantages. The main problem is poor thermal efficiency. Due to the high rate at which aluminum conducts heat, a room constructed from aluminum cannot stay comfortably cool in the summer without air conditioning or warm in the winter without supplemental heating. This drawback results in dramatically increased cooling and heating costs. Moreover, many of the windows in aluminum frame type sunrooms are generally installed in such a way that the windows cannot be opened and no screens are present. Another disadvantage is high maintenance. Aluminum must be painted if chipped and is easily dented. Construction of aluminum rooms is a major disadvantage as well. Because of the nature of the metal, the aluminum pieces must be assembled with external fasteners. External fasteners increase the time of assembly and degrade the overall aesthetics of the room.

In light of these various deficiencies, a need continues for a low maintenance sunroom/patio enclosure with improved thermal efficiency, screens, and sliding or double hung windows.

SUMMARY OF THE INVENTION

The aforementioned problems in the prior art are solved by the present invention. One object of this invention is a low cost plastic component-based sunroom/patio enclosure that is easily constructed. Advantageously, the framework components utilize an interlocking joint system based on a tongue and groove design that does not require the use of fasteners visible from the inside or outside of the enclosure. The preferred plastic material, polyvinyl chloride (PVC), is more thermally efficient and requires less maintenance than aluminum frame enclosures. The reinforced PVC framework accommodates the use of full size windows with screens. The enclosure includes interlocking frame members, thermally insulating kick plates, sliding windows, screens, and a roofing system. The kick plates are made of two plastic sheets, such as PVC sheets, adhered to an expanded polystyrene core that has a kerf along the lengths of each side which interfits with the framework. This combination of materials dramatically improves the insulation properties of the walls and as a result, improves the thermal efficiency of the room compared to aluminum. The kick plate panels fit into the channels in the framework without the need for fasteners or adhesives although an adhesive, preferably made of silicone, can be used.

The frame components include wall starters, floor starters, door jambs, jamb posts, corner posts, window sills, and headers, all of which are made from extruded plastic base profiles. Two adjacent channels separated by a medial ridge run the length of the extruded base profiles from which these frame components are adapted. At least one end of the vertical or elevated frame components is cut to provide a notch that receives the medial ridge of the frame component to which the component is joined at a frame joint. Hence, the notch is a "groove" while the medial ridge separating to the two adjacent longitudinal channels is a "tongue." The notch is cut into one frame component using a blade that imparts a concave shape which complements the convex contour of a ridge on the mating component. Except for the window sill, the extruded base profiles a hollow tubular space in which a reinforcing member, such as a composite wood material, is inserted for greater structural support. The roofing system includes panels and H-beams, with the panel ends fitting into the H-beams. The roof panels may have a reinforcing wood composite core for support. The roof panels may be made of two polyvinyl chloride sheets with an expanded polystyrene core. The foam core improves the insulation properties of the room and thus improves thermal efficiency further. Optionally, a skylight may be installed in the roof.

The sill includes two parallel channels for retaining full size sliding windows. A single or insulating double-pane window may be used. The exterior faces of the upright members and sills include screen tracks which retain conventionally framed screens. The screen tracks are integrally formed with the base profiles during extrusion. The screen tracks allow for easy removal and replacement of the windows and screens for cleaning.

According to another aspect of the invention, there is provided a series of plastic extruded base profiles from which the framework components are formed. According to another aspect of the invention, there are provided extrusion dies for making the base profiles.

According to another aspect of the invention, there is provided a fabrication shop for constructing the enclosure from its various starting materials. The fabrication shop is specifically designed to be a convenient and economical way of facilitating the construction of the enclosure. The fabrication shop includes work guide jigs and cutting tools mounted on a table to facilitate removal of selected portions of the screen tracks using a cutting tool mounted on the jigs. The fabrication shop also includes a notch mill machine for making notches at the ends of the framework components. The notch mill machine enables close tolerance construction of the enclosure. By providing a close tolerance fit between the notched end of one component and the channels of the component to which it is joined, the notch mill machine improves both the structural integrity and thermal insulation value of the enclosure when constructed.

DETAILED DESCRIPTION AND PREFERRED EMBODIMENTS OF THE INVENTION

Figure 1:
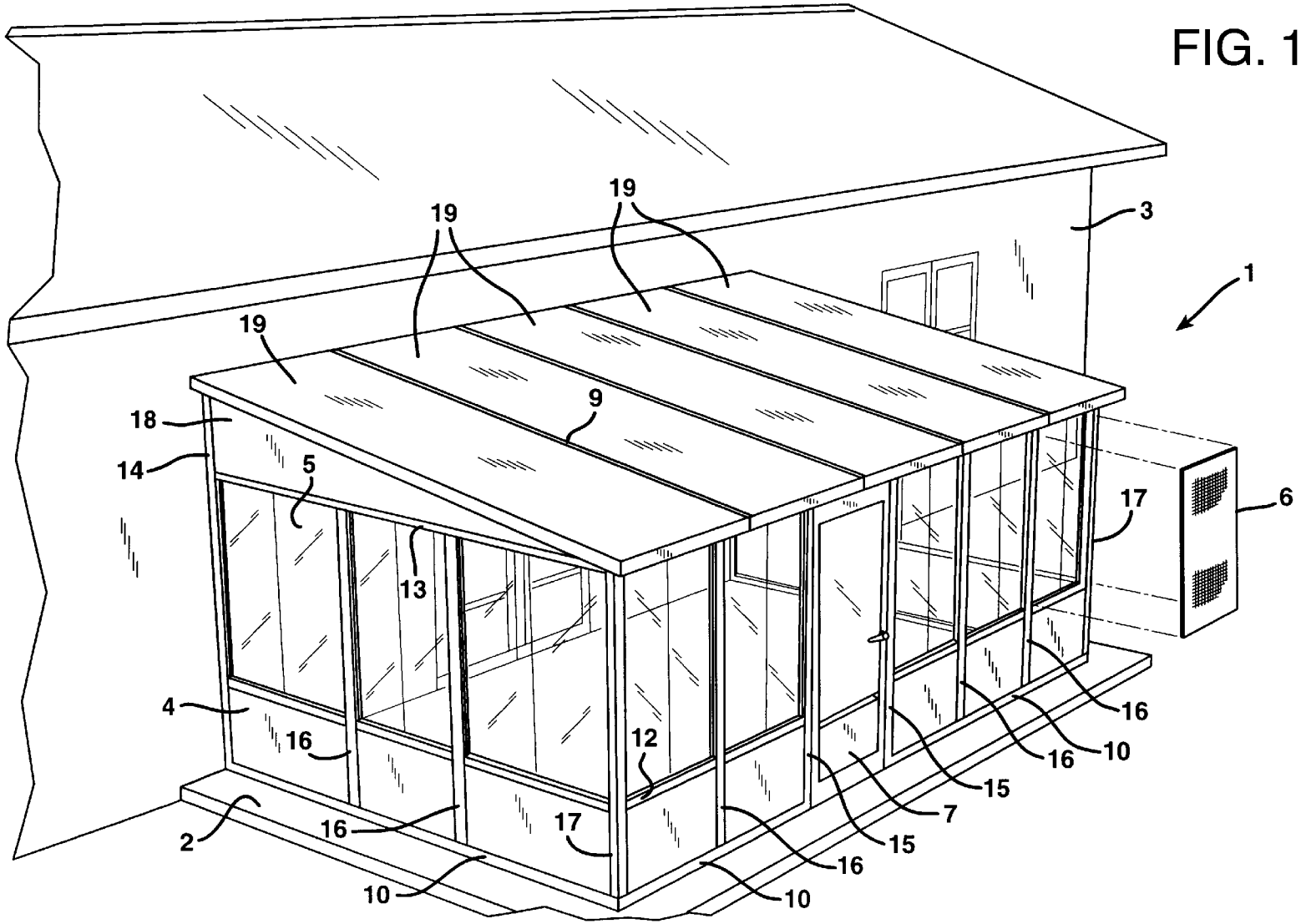
FIG. 1 is a perspective view of an exemplary embodiment of the enclosure.

FIG. 1 shows an exemplary enclosure constructed according to the present invention. The enclosure 1 is supported from below by a load-bearing substrate 2 and laterally by an existing structure 3, such as a house. The exemplary enclosure is formed by a framework of joined horizontal and vertical structural members, kick plates 4, multiple pairs of sliding framed windows 5, framed screens 6 between each pair of vertical frame members (one shown), an optional conventional door assembly 7, roof panels 19 separated by roof panel seams 9, and one or more optional conventional skylight units (not shown). The load-bearing substrate may be a concrete slab, wood decking, or the like.

Figure 2:
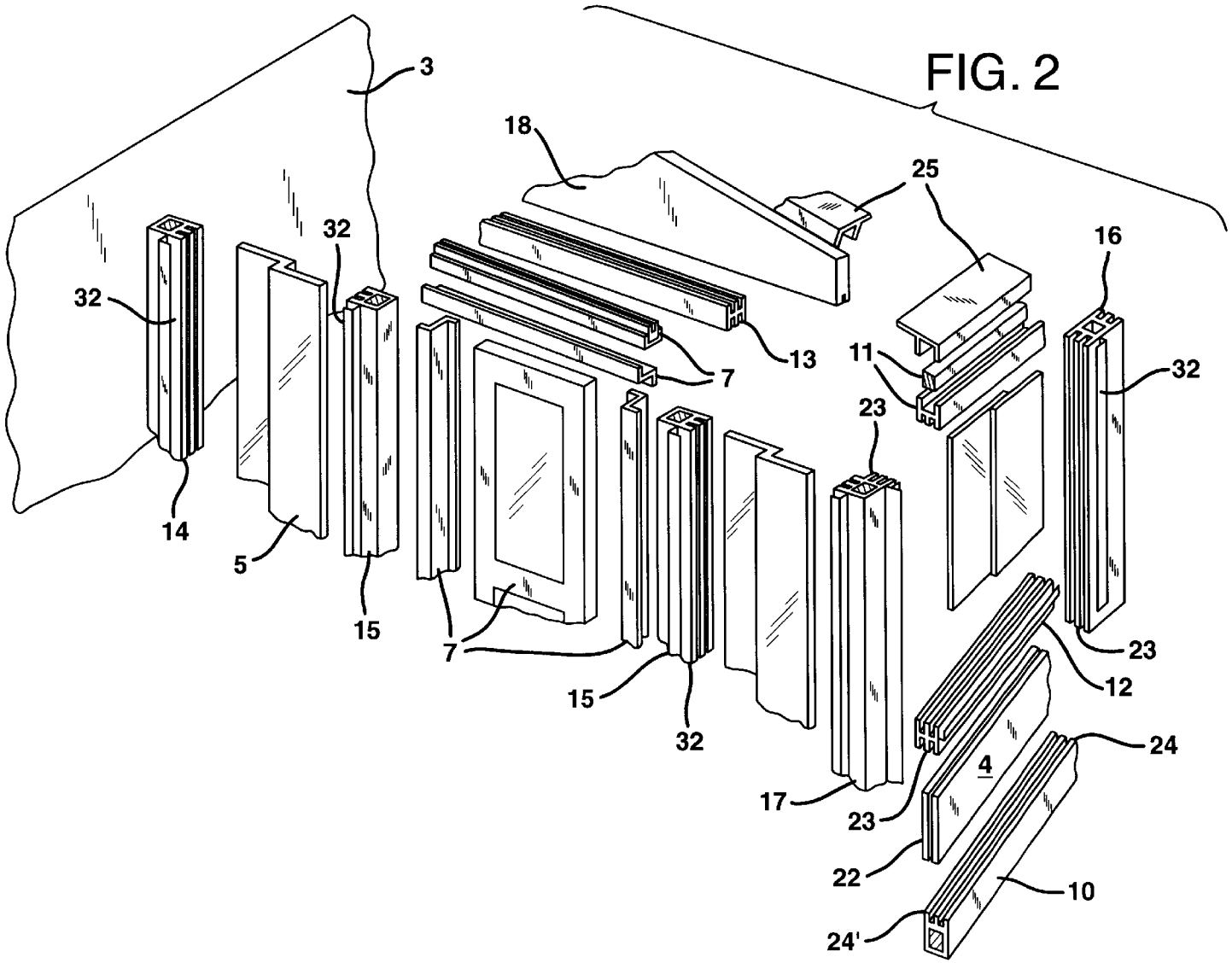
FIG. 2 is a perspective exploded view of the enclosure components.

FIG. 2 shows various structural members of the framework and other components of the enclosure in greater detail. The exemplary framework includes reinforced horizontal and vertical members joined together at joints. The reinforced horizontal members include floor starters 10 and a front header 11. The horizontal members that typically are not reinforced include sills 12 and side headers 13. The vertical members, all of which are preferably reinforced, include wall starters 14, door jambs 15, jamb posts 16, and corner posts 17.

Gable end filler panels 18 and roof panels 19 are supported by the framework.

Figure 3:
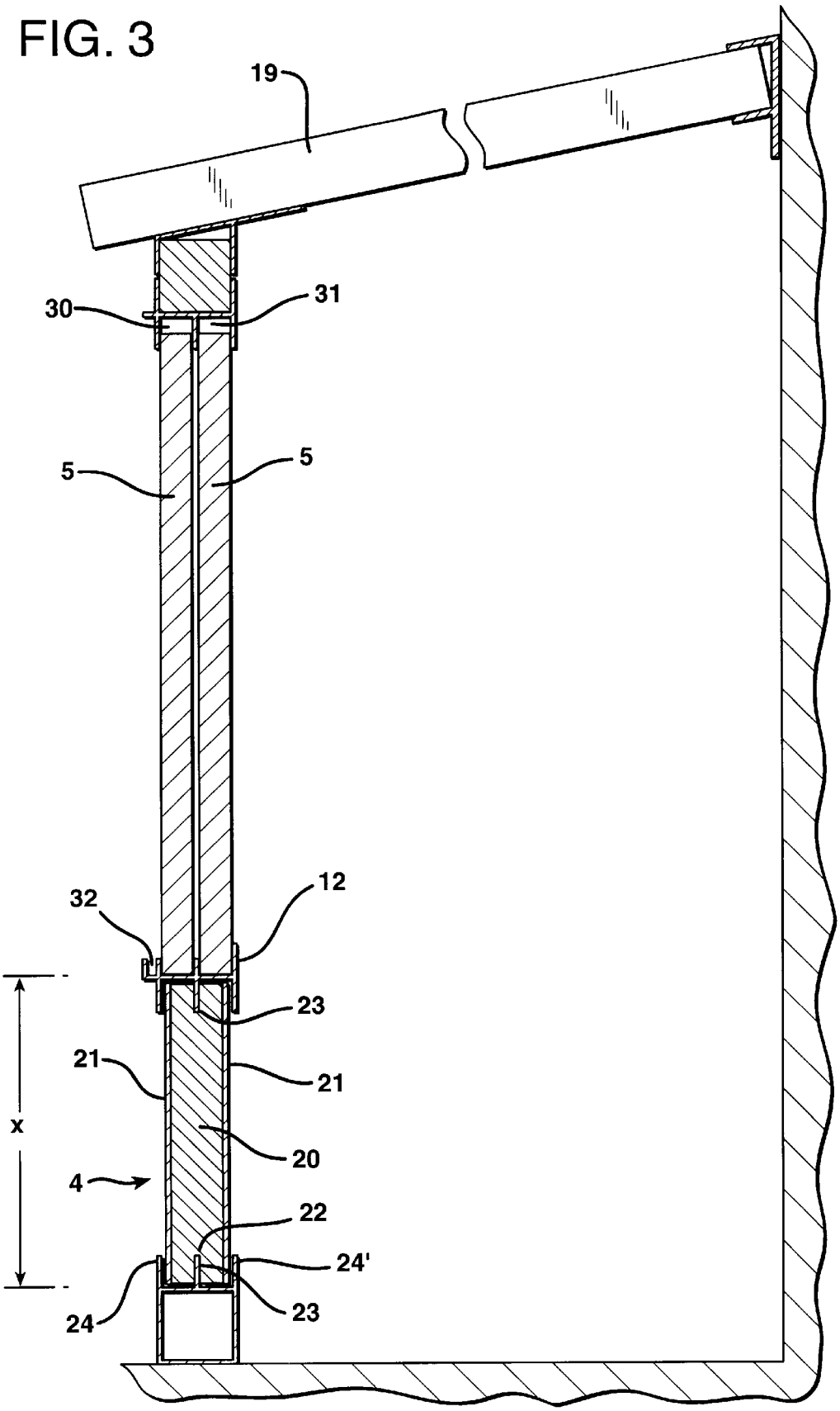
FIG. 3 is a side view of a wall section.

As shown in FIG. 3, the kick plate 4 is a rectangular panel that includes an expanded polystyrene core 20, typically having a thickness of 1⅝ in, sandwiched between two polyvinyl chloride sheets 21 typically having a thickness of 0.0625 in. The PVC sheets are preferably adhered to the foam core using any conventional adhesive suitable for joining PVC to expanded polystyrene foam. A preferred sheet material is InteDur Type I PVC sheet material available from The Inteplast Group of World-Pak Corporation. Typical property values of the Intedur Type I PVC sheet material are shown in Table 1.

TABLE 1

Physical Properties of Intedur Type I PVC sheet material

| PROPERTIES | TEST METHOD | UNIT | INTEDUR Type I |
|---|---|---|---|
| PHYSICAL | | | |
| Thickness | ASTM D1505 | in. | 1/16"–1/2" |
| Density | ASTM D792 | g/cm$^3$ | 1.36–1.40 |
| MECHANICAL | | | |
| Tensile Strength @ Yield | ASTM D638 | psi | 8,000–9,000 |
| Elongation @ Break | ASTM D635 | % | 25–45 |
| Flexural Modulus | ASTM D790 | psi | 380,000–430,000 |
| Flexural Strength @ Yield | ASTM D790 | psi | 7,000–13,000 |
| Izod Impact Strength (Notched) | ASTM D256 | ft.lb./in. | 0.8–2.5 |
| Shore Hardness (D Scale) | ASTM D2240 | D | 75–84 |
| THERMAL | | | |
| Heat Deflection Temperature | ASTM D648 | F | 145–155 |
| Vertical Burn Test | UL 94 | — | V–O |

A preferred adhesive is Vulkem polyurethane 116 caulk available from Mameco International of Cleveland, Ohio. A kerf 22 wide enough to fit over the medial ridge 23 of the structural members, typically 0.1875" wide, is cut into the expanded polystyrene on all four sides. The bottom of the kick plate fits into the floor starter channel (between the lateral ridges 24, 24') with the bottom kerf 22 receiving the floor starter medial ridge 23. The ends of the kick plate fit into the channels of the adjacent uprights with each end kerf receiving the upright's medial ridge in the manner described with respect to the bottom. The top of the kick plate fits into the channel of the sill 12 with the top kerf 22 receiving the sill's downwardly directed medial ridge 23.

The filler panel 18 at the gable end is similar in construction to the kick plate, but the shape is essentially triangular. See FIG. 2. A kerf is not required on the top edge of the gable end filler panel since the roof system rests flush on the gable end filler panel. An extruded PVC F-channel 25 is fit over the filler panel at the gable end and is fastened to the underside of the roof panels. See FIG. 2.

Figure 4:
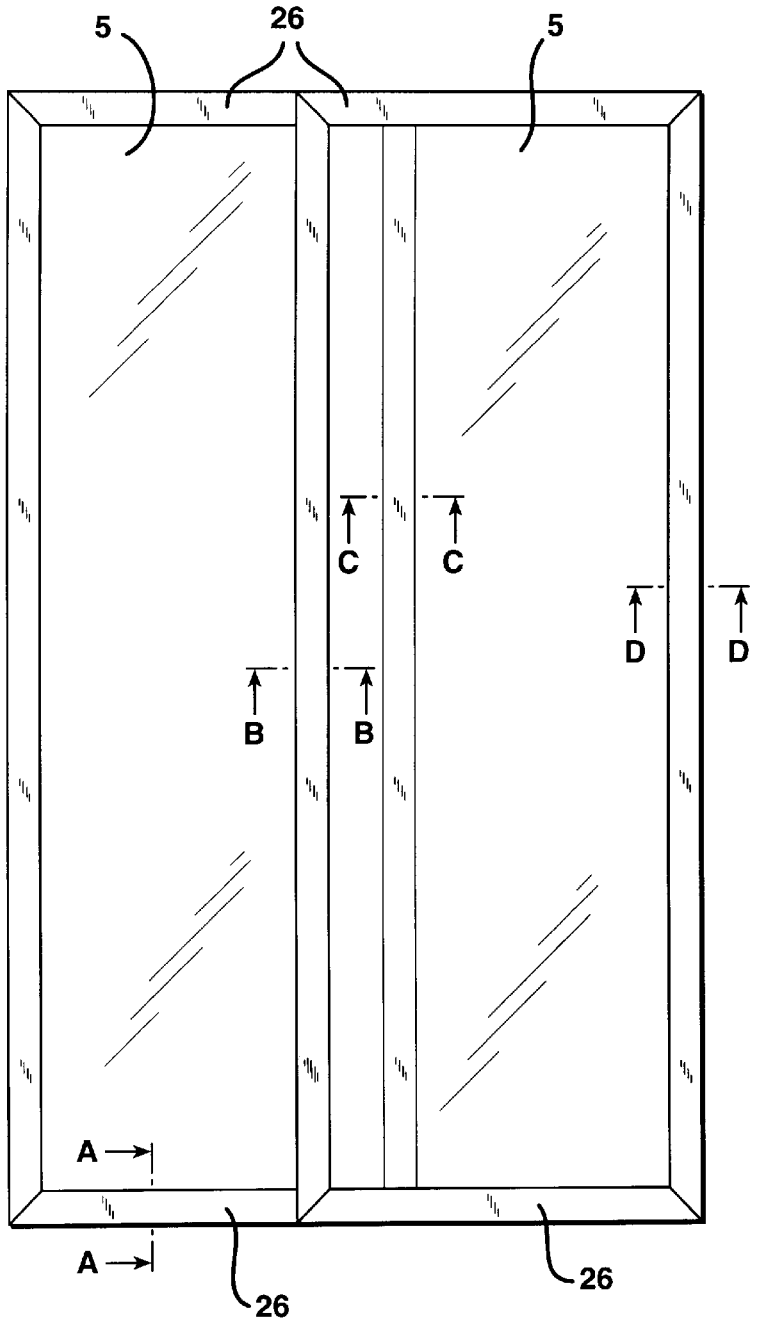
FIG. 4 PRIOR ART
FIG. 4 is a plan view of a prior art set of sliding framed window.
Figure 4A:
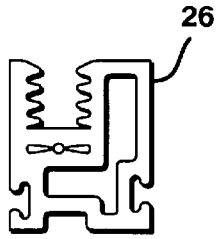
FIGS. 4A–4D are sectional views of prior art window sashes.
Figure 4B:
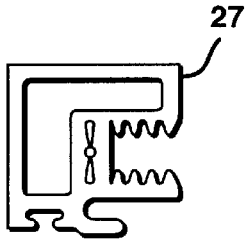
Figure 4C:
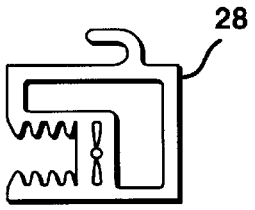
Figure 4D:
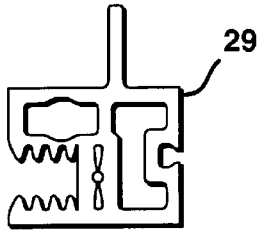

Each window opening in the framework preferably has two sliding framed windows 5, one per window track of the sill 12. As shown in FIG. 4, a sash set is placed around the perimeter of each window pane. The set includes a bottom sash 26 (FIG. 4A) for placement along the bottom edge of the window pane. If insulated glass is used, two sets of single nylon rollers (not shown) preferably are attached to the underside of the bottom sash. A header sash 26 having the same cross sectional shape as the bottom sash is placed along the top edge of the single window pane. Preferably, a meeting rail with a male interlock 27 (FIG. 4B) is used on one of the two window sashes while a meeting rail with a female interlock 28 (FIG. 4C) is used on the other window. Finally, a sash handle and lift rail 29 (FIG. 4D) is located on the window edge nearest the frame when the window is closed. Hence, for a window construction having two sliding window sash sets per window opening, one window will include a bottom sash, a sash handle and lift rail, a meeting rail with male interlock, and a header sash. The sashes are joined at the window corners by conventional techniques. The other window will include a bottom sash, a sash handle and lift rail, a meeting rail with male interlock, and a header sash. While any conventional sash design of the appropriate width capable of being placed in the window tracks could be used, the cross sectional profiles of the sashes shown in FIG. 4A–4D are preferred. In case one fixed window which does not open or close is desired instead of two sliding window sashes, the bottom sash 26 (FIG. 4A) is placed around all four sides of the window pane. The sashes can be extruded at 340 degrees F. using the same rigid PVC from which the frame base profiles are made. The average wall thickness of the sashes is typically 0.080". Preferably, each sash includes a conventional stiffener, such as a metal rod, for oversized windows.

Once constructed, the window sash is slipped into the window track formed by the sill, uprights (such as the wall starter and jamb post, doorjamb, or post), and header. As seen in FIG. 3, one framed window is placed in the outer track 30 while the other framed window is placed in the inner track 31. Each framed window slides easily through each track since the window frame is thinner than the width of each track. A clearance space is provided above the windows so that the windows can be lifted up and pulled out over the window sill ridges for replacement or cleaning.

Framed screens are made in any known conventional manner. The framed screens are slipped down into the screen tracks 32 provided by the sill and adjacent uprights.

Figure 5A:
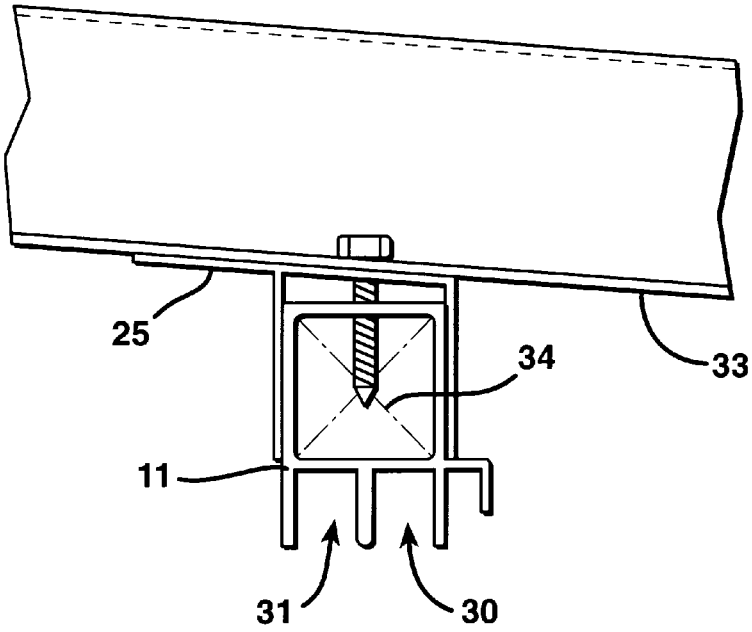
FIGS. 5A–5B are sectional views of the roof panel/header connection.
Figure 5B:
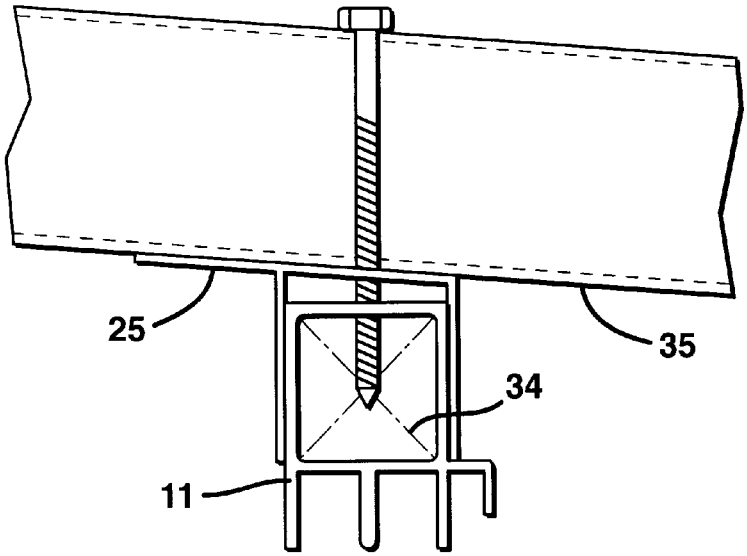

The roof decking can be any conventional engineered and approved type roof decking material with a maximum weight of 5 psf (pounds per square foot). A preferred insulated panel is described in U.S. Pat. No. 5,293,728, the disclosure of which is incorporated herein by reference. The roof panels should be installed per the manufacturers instructions and should span the entire projection of the enclosure. They should be connected to the existing building by the manufacturer's plan/approval or by a detail stamped and signed by a licensed engineer or architect. The roof decking can be a core of polystyrene foam sandwiched between light gauge metal skin, such as light gauge aluminum. The core may be about 3"–4" thick, for example, 3.2" thick. As shown in FIG. 5A, light gauge aluminum decking can be attached to the header by driving a #10 washer headed screw through the roof decking 33 material into the F-channel 25 placed over a header and header insert 34. Preferably, foam injected roof panels 35 can be used. As shown in FIG. 5B, an aluminum sandwich type roof decking material having a foam core can be used. Foam core sandwich type panels can be attached to the F-channel, header 25, and header insert 34 in a similar fashion as shown in FIG. 5A, only with a ¼" diameter lag bolt as shown in FIG. 5B.

Figure 6:
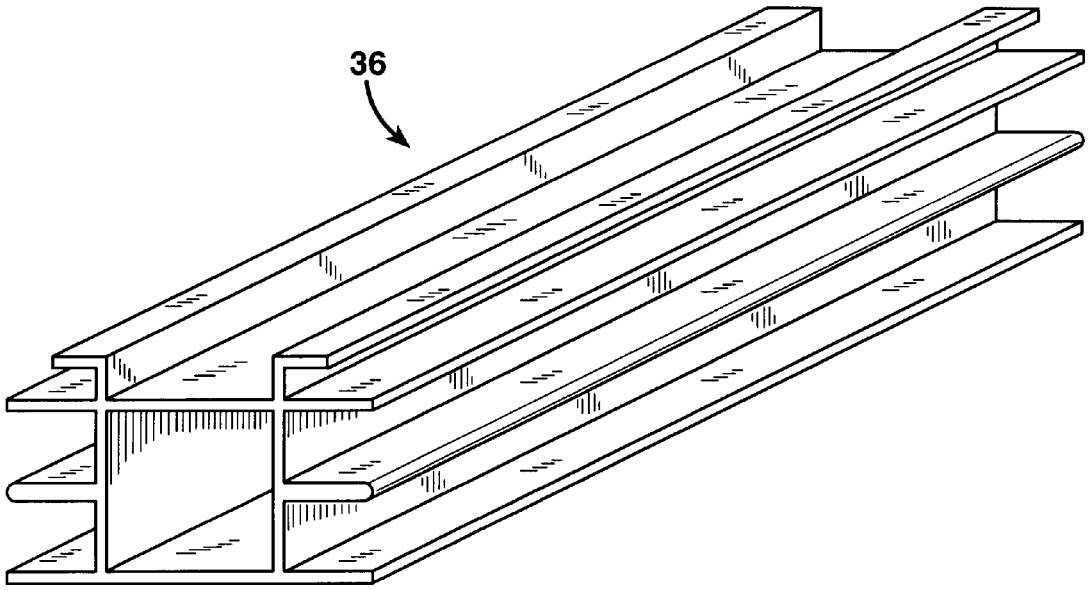
FIG. 6 is a perspective view of a jamb post base profile.

As mentioned above, the framework is constructed of members fabricated from extruded plastic base profiles having distinctive characteristic cross-sectional shapes throughout their entire length. FIG. 6 shows an extruded jamb post base profile 36 having the characteristic "jamb post" cross section. The characteristic cross sectional shapes from which the framework members are constructed are shown in FIG. 8*a*, FIG. 9*a*, FIG. 10*a*, and FIG. 11*a*. The base profiles shown are the base jamb post 36, base starter 37, base corner post 38, and base sill 39, respectively. The profile of the F-channel is also shown in FIG. 12.

Figure 7:
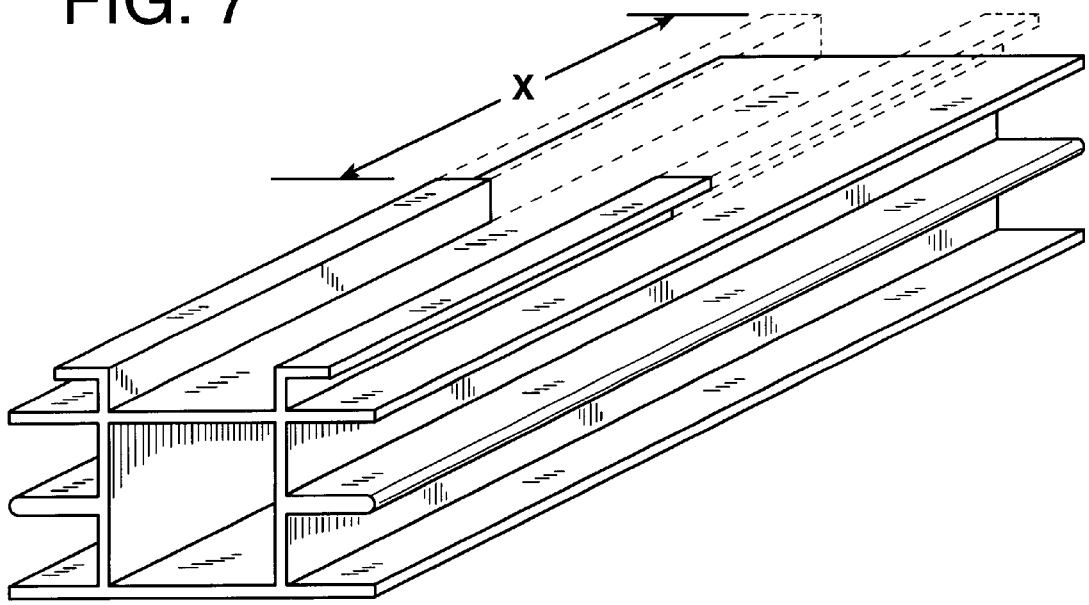
FIG. 7 is a perspective view of a jamb post with a portion of the screen track removed.

As can be seen in the illustrated base profiles, the screen tracks are formed by screen track extensions 40 initially formed as an integral portion of the extruded profiles. The screen track 32 therefore extends along the entire length of the respective extruded base profile. In the enclosure, however, the screen tracks are required only below and to the side of the window openings in order to retain the screens. Therefore, in making the structural members from the base profiles, a portion of the screen track extension is removed from those portions of the profile that do not require screen tracks, as shown in FIG. 3 and FIG. 7.

Each of the base jamb post 36, base starter 37, and base corner post 38 profiles includes a tubular space 41 defined by a tube wall 42 formed during extrusion of the profile and which surrounds the tubular space. Preferably, the tubular space is polygonal in shape, but a circular shape is also possible. More preferably, the shape of the tubular space is square. The tubular space is adapted for receiving a complementary shaped reinforcement insert 34 into the tubular space, such as a wood insert having a complementary, preferably square, cross-sectional shape and extending substantially the full length of each of these framework members. The drawings may indicate the presence of an insert by an enlarged "X" filling in the tubular space. See FIGS. 5A and 5B.

Each of the base jamb post 36, base starter 37, base corner post 38, and base sill 39 includes three substantially parallel ridges extending outwardly a substantially equal distance from the tube wall on one or two exterior sides of the member. The medial ridge 23 is located between and substantially equally apart from two substantially parallel lateral ridges 24, 24'.

The screen track extension 40 and adjacent outer lateral ridge 24 form a generally U-shaped screen track 32. This outer lateral ridge 24 and the medial ridge 23 form one generally U-shaped outer window track 30. The medial ridge 23 and the inner lateral ridge 24' (the lateral ridge furthest from the screen track) form generally U-shaped inner window track 31. Since the lateral ridges 24, 24' and the medial ridge preferably extend approximately the same distance from the extruded tube wall forming the tubular space, the adjacent window tracks are approximately the same depth. Further, since the medial ridge 23 is preferably mid-way between the lateral ridges 24, 24', adjacent window tracks have substantially the same width. Accordingly, window frames that fit into one window track will fit inside the other track as well. If desired, the track widths can be different by appropriately locating the medial ridge 23 closer to one lateral ridge 24, 24' than the other.

The preferred material from which the profiles are extruded is RPVC (rigid PVC) type polyvinyl chloride. The PVC can be any color, such as white or almond. Virtually any known PVC composition can be used that provides adequate strength and machinability in light of this disclosure. Preferably, the PVC compound used includes conventional UV absorbers making the PVC suitable for use outdoors. Among the many PVC compound formulations which can be used are KBS016 WH 433 and BG716 WH433 available from K-BIN Corp., Houston, Tex.

Figure 8A:
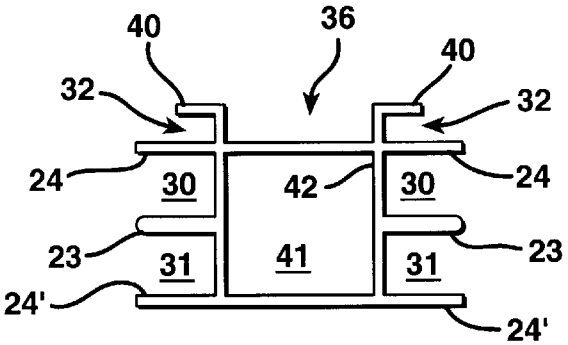

As shown in FIG. 8A, the jamb post profile 36 includes two sets of outwardly projecting ridges and screen tracks disposed 180° apart at opposite sides of the tubular space 41. The starter profile 37 (FIG. 9A) includes one set of ridges and one adjacent screen track. Like the jamb post profile, the corner post profile 38 (FIG. 10*a*) also includes two sets of ridges and screen tracks, but the sets are disposed 90° apart on adjacent rather than opposite sides of the tubular space.

As noted above, the floor starter, wall starter, jamb post, corner post, and front header are preferably structurally reinforced by an insert placed in the tubular space of these members. The insert increases the rigidity and load-bearing strength of the members. A typically convenient material is a wood beam. While any type lumber could be used, oriented strand board is preferred, such as PARALAM or beams made by the TIMBERSTRAND® LSL process from Trus Joist MacMillan, LP, Boise, Id. Preferably the size of the inserts is such that they are inserted easily but fit snugly in the tubular space so than there is little "play" or travel of the insert in the interior space. The inserts are held in place by common fasteners, such as wood screws. The preferred insert for the header is 1.5E grade TIMBERSTRAND. The preferred insert for the jams, columns, corner posts and starters is 1.3E grade TIMBERSTRAND. The grade relates to the modulus of elasticity of the material. Equivalent materials can also be used.

For each of the various structural members, the portions of the screen tracks that will not be adjacent to a window in the assembled enclosure removed from the base profile before the structural component is installed.

Figure 11A:
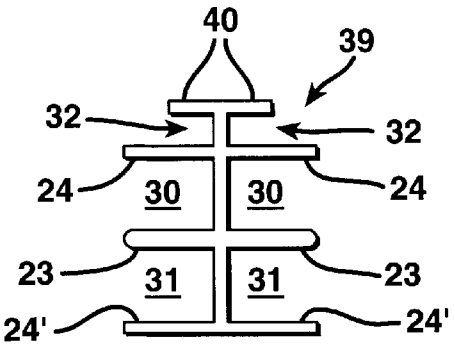
Figure 11B:
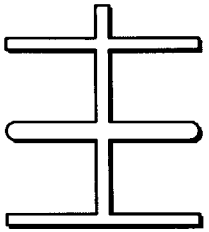
Figure 12:
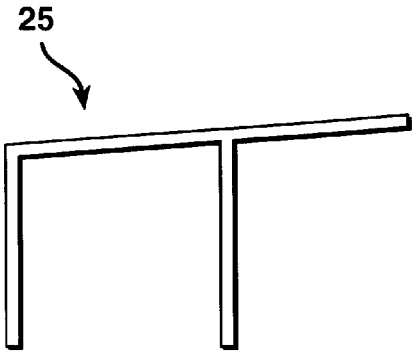

The base extrusion for the sill component 39 is shown in FIG. 11A. Preferably, the bottom side of the screen track is removed for aesthetics and since it serves no purpose, but could remain on the sill if desired. The top sections of the ridges (above the score line) are removed by scoring and snapping or with a table saw. Both ends of the sill are notched using the notch mill. Routing fixtures are used to produce weep holes in the sill. Weep holes are holes in the sill that allow water to escape to the outside of the enclosure.

Figure 11C:
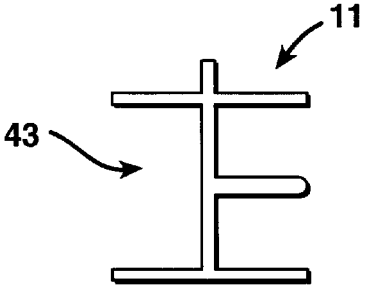
Figure 11D:
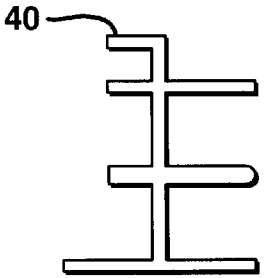

The wood filled front header 11 is shown in FIG. 11C. It may be advantageously formed from a base sill profile 39 shown in FIG. 11A. The screen track extension 40 and the medial ridge 23 on one side of the sill can be removed by scoring and snapping or with a table saw. A wood composite material is placed in the header channel 43 created by the removal of the medial ridge 23. The wood composite material is fastened in the channel by screws. Both ends of the header are notched using the notch mill. As the final step for this component, the wood composite material is cut lengthwise at an appropriate roof pitch so as to allow the roof to lay uniformly flat on the header, as shown in FIG. 2.

Figure 10A:
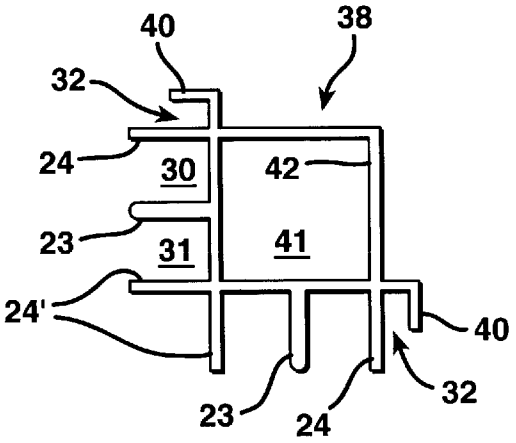
FIGS. 8A, 9A, 10A, 11A, 12 are sectional views of the base profiles.
Figure 10B:
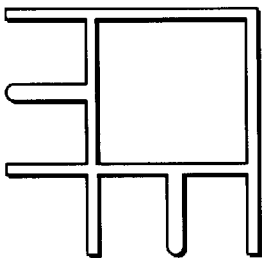
FIGS. 8B, 9B, 10B, 11B, 11C, and 11D are sectional views of modified profiles.
Figure 9A:
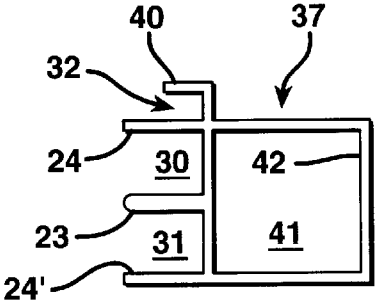
Figure 9B:
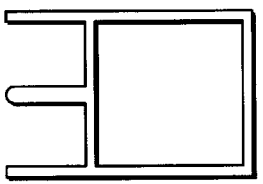
Figure 8B:
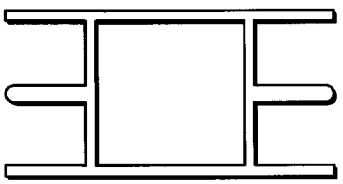

FIG. 7 shows in phantom the portions having length "x" of the screen tracks of a jamb post that will be positioned below rather than adjacent to a window once the enclosure is assembled. FIG. 3 shows that the portion of the vertical members that does not require a screen track in use corresponds approximately to the height of the kick plate. The horizontally disposed screen track of the sill is shown. FIG. 8*b*, FIG. 9*b*, and FIG. 10*b* show the cross-sectional shapes of the portions of respective base profiles with the screen tracks removed. The screen track remover apparatus 44 (described below) removes the selected portions of the screen tracks. The entire screen track is ordinarily removed only from the floor starter.

Figure 13:
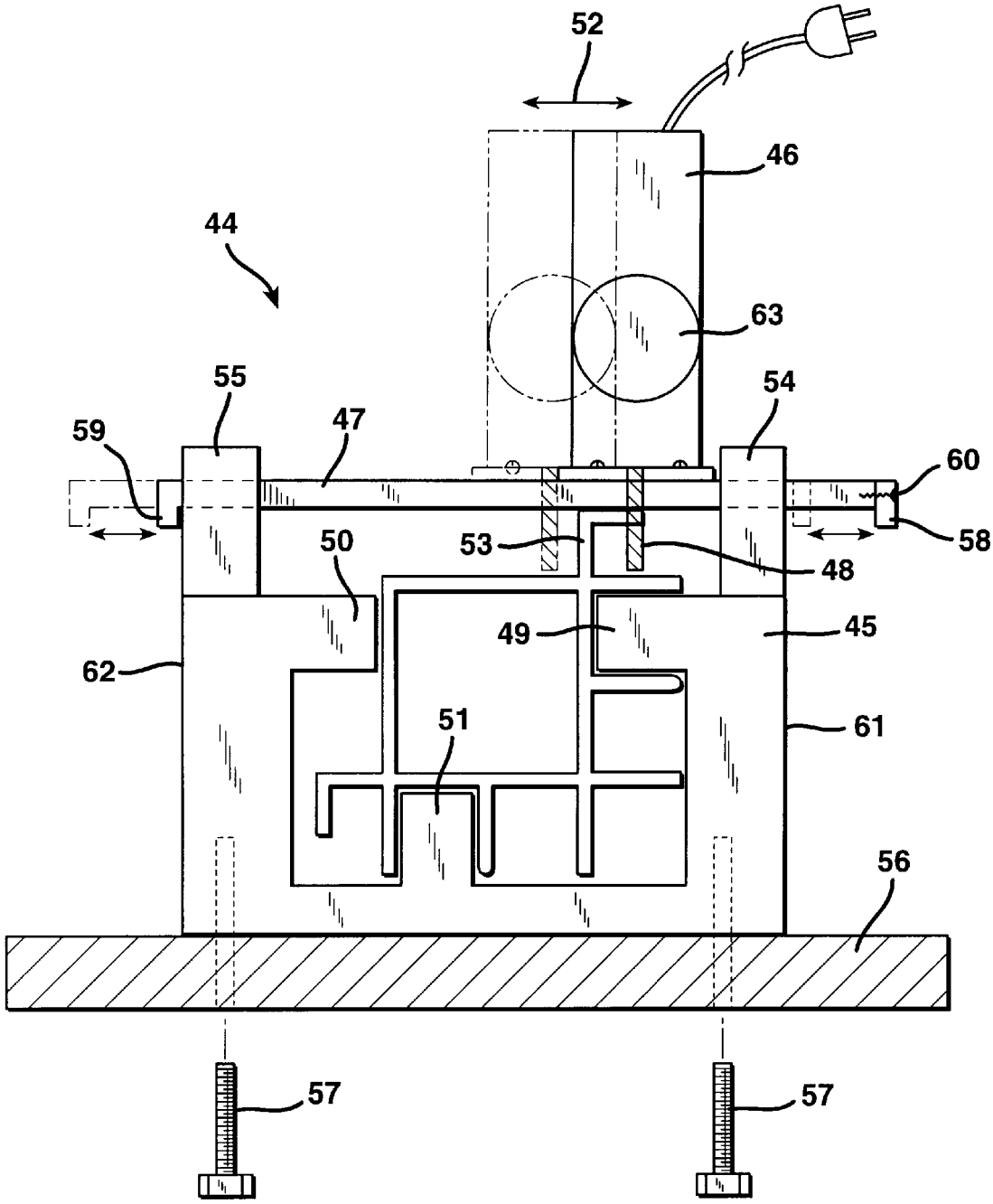
FIG. 13 is a end view of the screen track removal apparatus.
Figure 14:
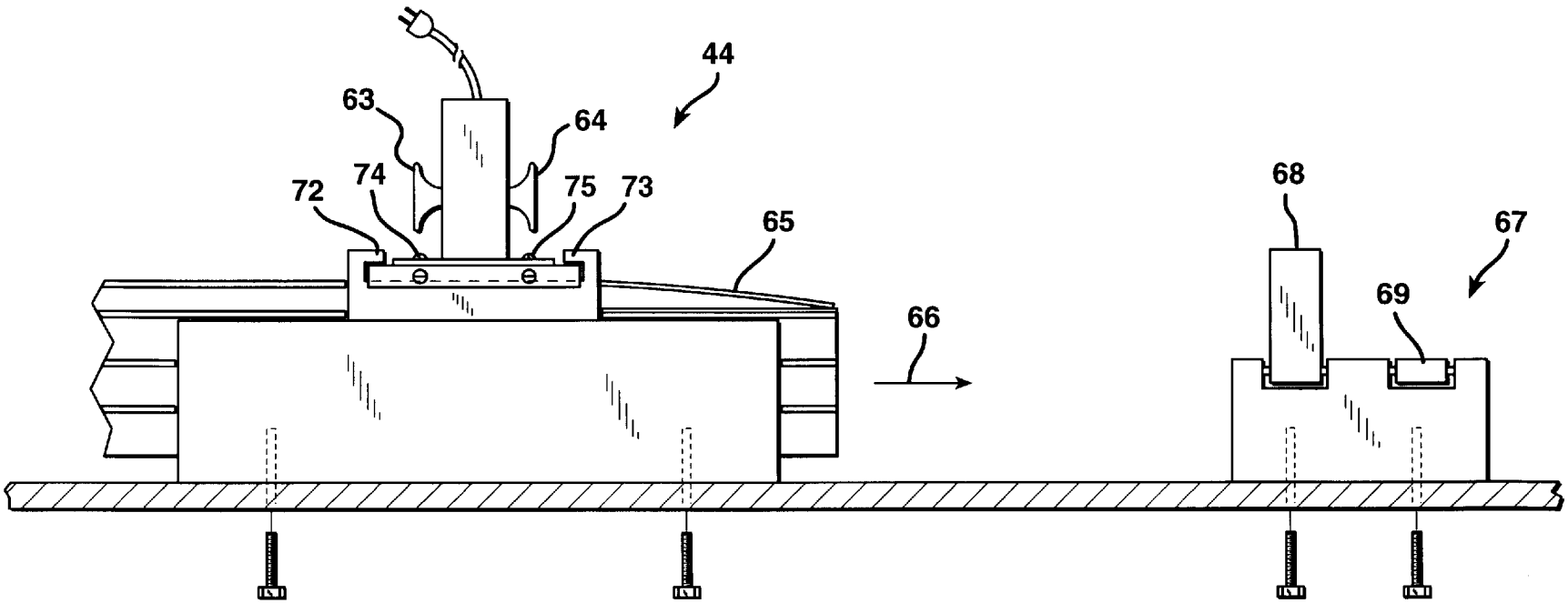
FIG. 14 is a side view of the screen track removal apparatus and the stop jig.
Figure 15:
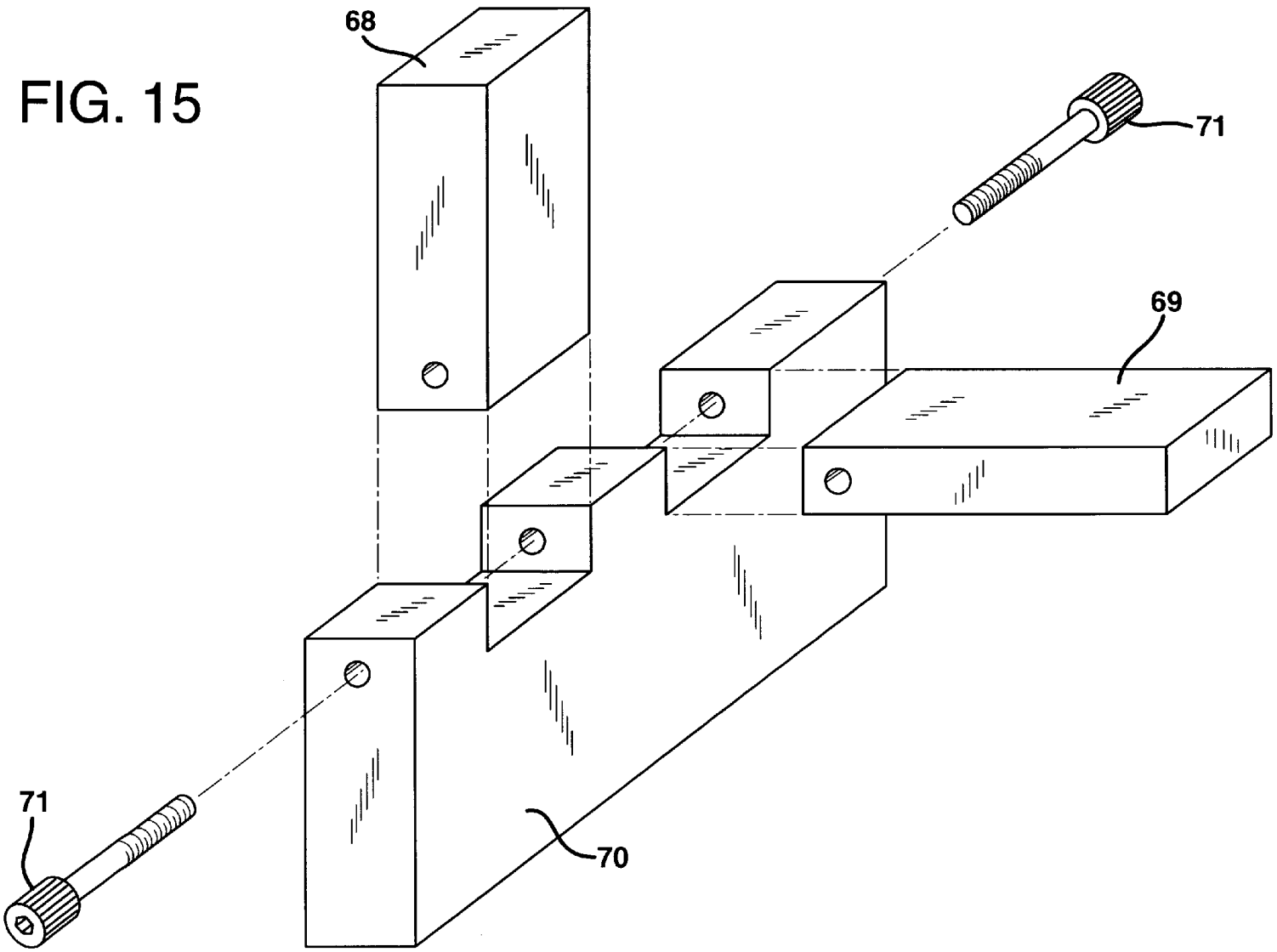
FIG. 15 is a perspective view of the stop jig.

A portion of the screen track can be removed from the jamb post base profile, corner post base profile, and floor starter base profile using the exemplary screen track remover apparatus according to the invention shown in FIGS. 13–15. The base profiles are extruded having a screen track extension and then some, none, or all of the screen track extension is removed so that a smaller number of different base profiles are required to build an enclosure. While a floor starter without a screen track extension could be extruded, a larger number of different parts would have to be manufactured and stocked by the factory. Extruding base profiles having a screen track extension along substantially the entire length of the profile more easily accommodates the building of enclosures having non-standard kick plate heights, for example, without the added complication of stocking parts which vary only in the point at which the screen track begins. The decision of determining how much of the screen track extension should be removed is made more easily with greater flexibility by individual contractors or designers in the field rather than in a centralized factory prior to distribution of the product.

The screen track removal apparatus 44 includes a base profile guide 45, router 46, and router shuttle plate 47. As shown in FIG. 13, a base corner post profile 38 is being guided and supported by a profile guide 45. The router is mounted on a router shuttle plate. The shuttle plate is supported on the sides by shuttle plate support ledges 54, 55. The purpose of the shuttle plate is to support the router above the profile and enable the router to be traversed across the riser in the manner indicated by arrow 52 in FIG. 13. The corner post profile 38 is oriented so that the screen track extension to be removed is directed upwardly towards the router cutting tool bit 48. The guide 45 provides anti-rotational lateral support and vertical support to the profile 38 by means of three guide rails 49, 50, 51. Two upper guide rails 49, 50 are provided to fit into a profile's outer window track or tracks 30. As shown in FIG. 13, only one of the upper guide rails occupies a corner post window track. Specifically, upper guide rail 49 occupies the window track 30 closest to the screen extension being cut off. Upper guide rail 50 simply provides lateral support to the profile without occupying a profile window track for a corner post profile. In the case of a jamb post, however, the two upper guide rails 49, 50 would occupy the two outer window tracks 30 of the jamb post profile 36 that are adjacent to a screen extension. The guide 45 also includes a lower rail 51 which fits into an outer track 30 to provide vertical and lateral support only in the case of the corner post profile 38, as shown in FIG. 13. For other profiles, such as jamb post profiles 36 and starter post profiles 37, the lower rail 51 provides only vertical support.

As indicated by motion arrows 52 and the phantom lines, the router can traverse across the width of the screen track extension 40. Ordinarily, when a screen track is being removed, the cutting tool is transversely aligned with the riser portion 53 of the screen track extension 40. The tool is not depicted that way in FIG. 13 for clarity. Rather, the router cutting tool bit 48 is shown to the right of the riser and to the left of it in phantom.

As the profile is advanced by a technician through the screen track removal apparatus, the screen track extension 40 is removed from the profile by the fixed-position router. Once the profile has hit the selected work stop (described below), the router is shuttled back and forth across the screen track extension 40 in the direction shown by arrow 52 in FIG. 13 for the purpose of making a clean square cut across the entire extent of the screen track extension riser 53 at that position.

The guide, shuttle plate, and shuttle plate ledge are preferably made from an inexpensive and easily machined material suitable for making a workpiece guide, such as aluminum or other soft metal. Preferably, the guide 45 is mounted to a table 56 or other support structure by known conventional fasteners, such as bolts 57. Shuttle stops 58, 59 on the shuttle plate prevent the router from advancing so far along or out of the shuttle plate ledges that the router could inadvertently be removed from the guide. At least one shuttle stop 58 can be removed by removing shuttle stop fastener from the shuttle plate 60 so the shuttle plate can be removed from the shuttle plate ledges if desired.

While the guide, including upper rails, lower rail, base, and guide walls 61, 62 are shown as being machined from a single block of material, the skilled artisan will recognize that one of more of these portions of the guide could be machined separately and assembled together using appropriate fasteners known to those skilled in the art.

The router is a conventional high-speed electric router. Preferably, the router includes handle grips 63, 64 for grasping the router. The router tool bit is preferably at least as wide as the thickness of the screen extension riser so that the screen track may be removed as the profile is fed into the jig without having to shuttle the router until the end of the cut.

FIG. 14 is a side view of the router and profile of FIG. 13. The detached portion 65 of the cut screen track extension can be seen falling under its own weight as the profile advances in the direction of motion 66. The multiple-position stop jig 67 is also depicted. As shown, the left stop member 68 of the stop jig is in the elevated or non-blocking position. The right stop member 69 is in the lowered, blocking position. The base profile and stop jig are axially aligned so that the profile will abut a lowered stop member 69 but will not be impeded by an elevated stop member 68. The stop jig is positioned on the guide table 56 or other support surface at a fixed predetermined distance from the cutting tool. The predetermined distance is selected based on the length "x" shown in FIG. 3 for which removal of the screen track is desired. The stop jig may include more than one stop member set at different distances from the cutting tool to accommodate different heights "x."

FIG. 15 details one possible construction of the stop jig 67. Two stop members are shown each one pivotally mounted on a jig body 70 by appropriate pinion fasteners 71.

FIG. 14 also shows the side view of the shuttle plate ledge. The "C" channel ends 72, 73 prevent the shuttle plate and the router to which it is attached from being raised out of the shuttle plate ledge inadvertently. The router is mounted onto the shuttle plate by appropriate router mounting fasteners 74, 75.

A method of constructing an exemplary enclosure according to the invention will now be described. Either before or after the reinforcement is secured to the base starter profile, using, for example, the apparatus 44, the entire screen track is removed from the base starter profile to form the floor starter. Since the entire screen track is removed, all stop members are raised to the non-blocking position. If not already done, the reinforcement is inserted into and securely attached to the PVC profile with appropriate known fasteners, such as wood screws 80. The reinforced floor starter is then cut to length. A floor starter running along the side of the enclosure is provided with a square cut at the existing structure end. Square cuts are also provided at the floor starter ends abutting a door assembly. The ends of the reinforced floor starters located at corners of the enclosure are provided with 45 degree cuts.

Figure 16:
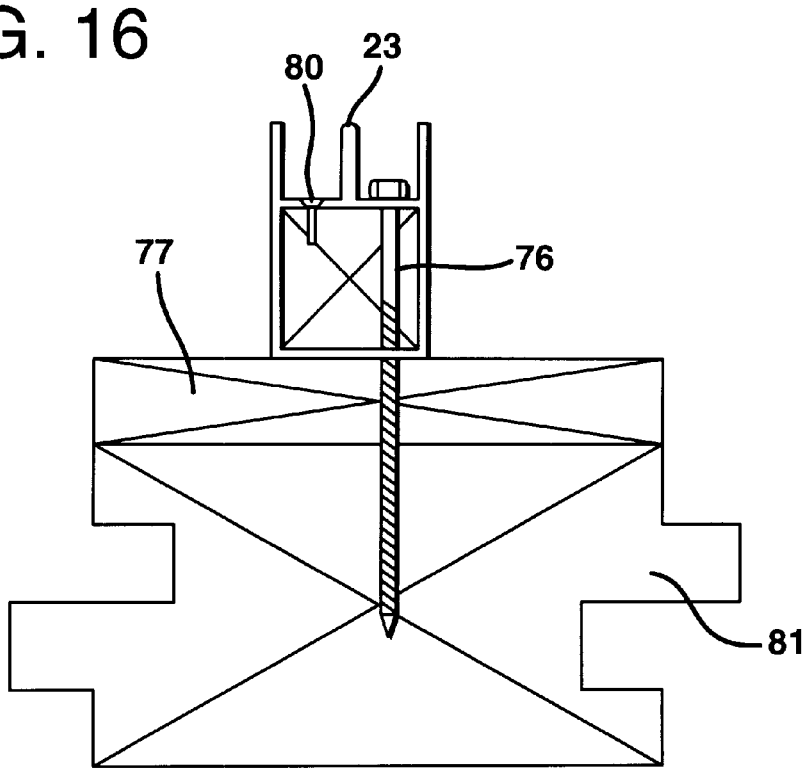
FIG. 16 is a sectional view of a floor starter mounted to a wood deck.
Figure 17:
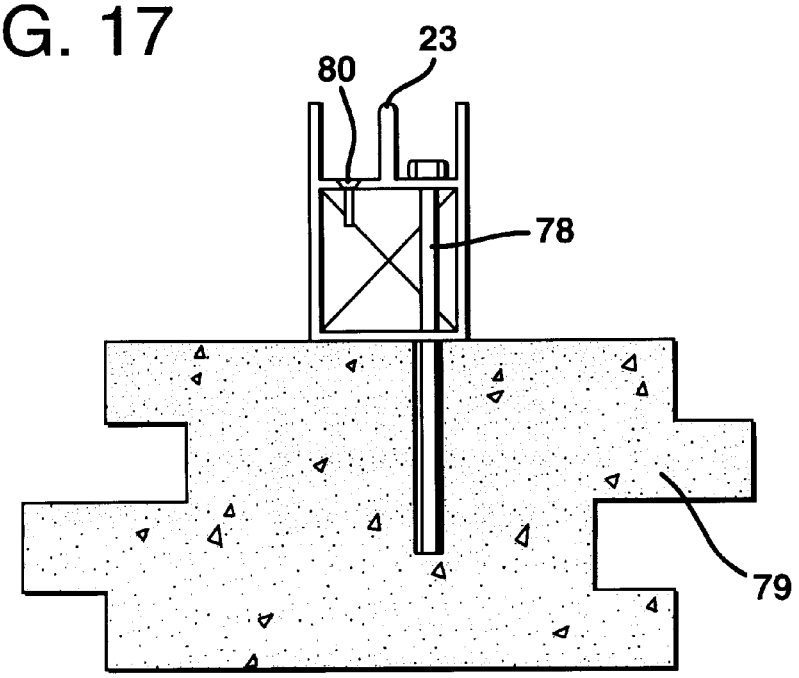
FIG. 17 is a sectional view of a floor starter mounted to a wood deck.

The reinforced floor starter is securely mounted to the supporting structure using appropriate known mounting hardware, such as lag bolts 76 for decking 77 and joists 81 or other wood substrates or concrete anchors 78 for a concrete slab 79, as shown in FIG. 16–17. The window tracks and medial ridge 23 point upwardly. The floor starter is mounted everywhere around the perimeter of the enclosure being assembled except where a known conventional door assembly or other opening is desired.

Figure 19:
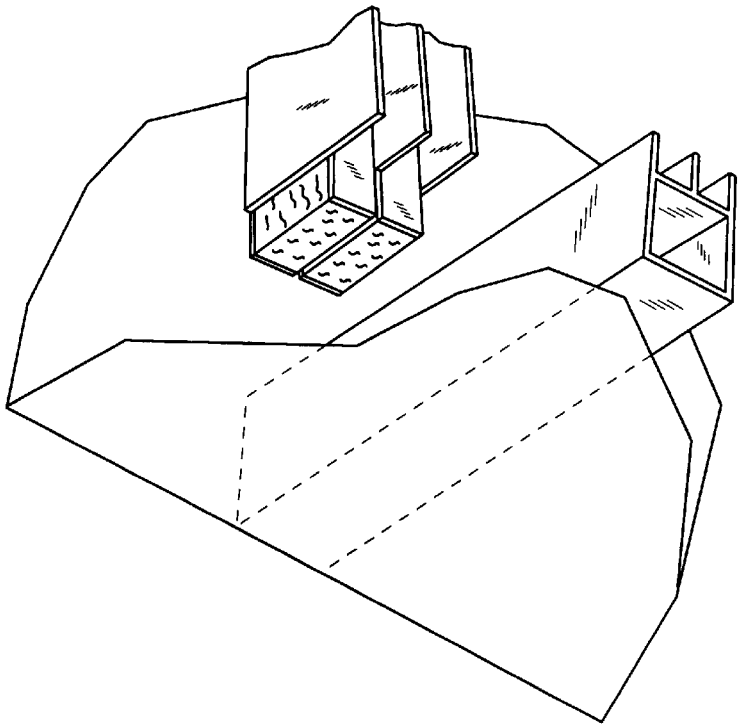
FIG. 19 is a perspective view of the ends of a wall starter and a floor starter.

A wall starter is reinforced by an insert in a similar manner, but only a portion of the screen track is removed so that a screen track remains on the exterior face of the installed wall starter. In use, the remaining portion of the screen track retains one edge of the framed screen in place. The end of the wall starter is then notched by any suitable method or cutting tool, such as by the notch mill machine described below. FIG. 19 details the characteristic ridge-and-notch joint between the vertical members, such as a wall starter, and the horizontal members, such as a floor starter. The wall starter is installed by aligning the bottom of the wall starter with the floor starter so that the ridges in the floor starters are inserted into the notch of the wall starter. The joint is secured using suitable hardware, such as by fastening an L-bracket in each of the two tracks between the members at the joint. The L-brackets are installed within the tracks so that placement of the kick plates in the channels in a subsequent step is not impeded. The wall starter is anchored to the existing structure, e.g., house, with appropriate anchoring devices (not shown).

Figure 18:
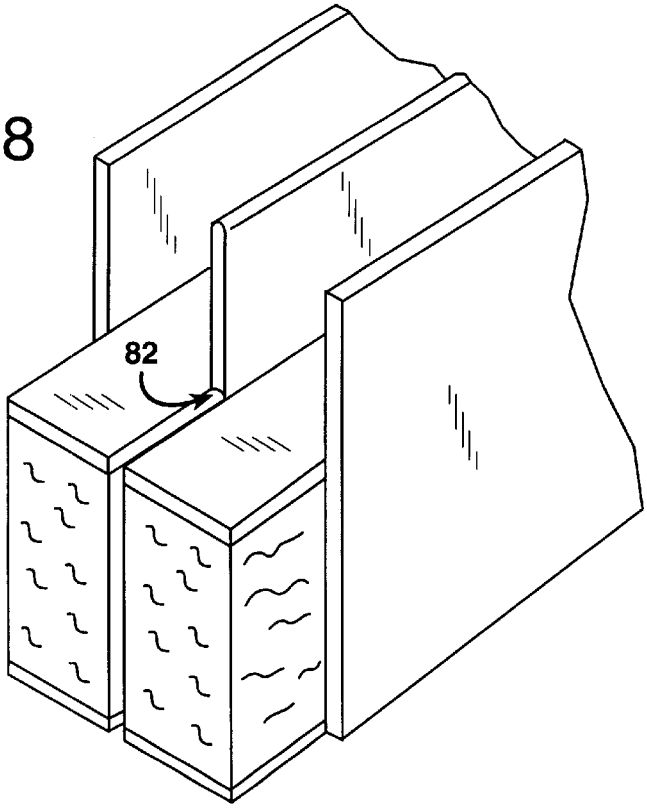
FIG. 18 is a perspective view of an end of a wall starter.

The joint end structure is detailed in the enlarged view of the wall starter end in FIG. 18. One especially advantageous feature imparted to the wall starter end is the concave shape 82 provided at the bottom of the notch by the cutting blades of the notch mill machine described below. This concavity complements in close interfitting relationship with the convex shape characteristic of the medial ridges of all the base profiles, as shown for example in FIG. 16–17.

Figure 22:
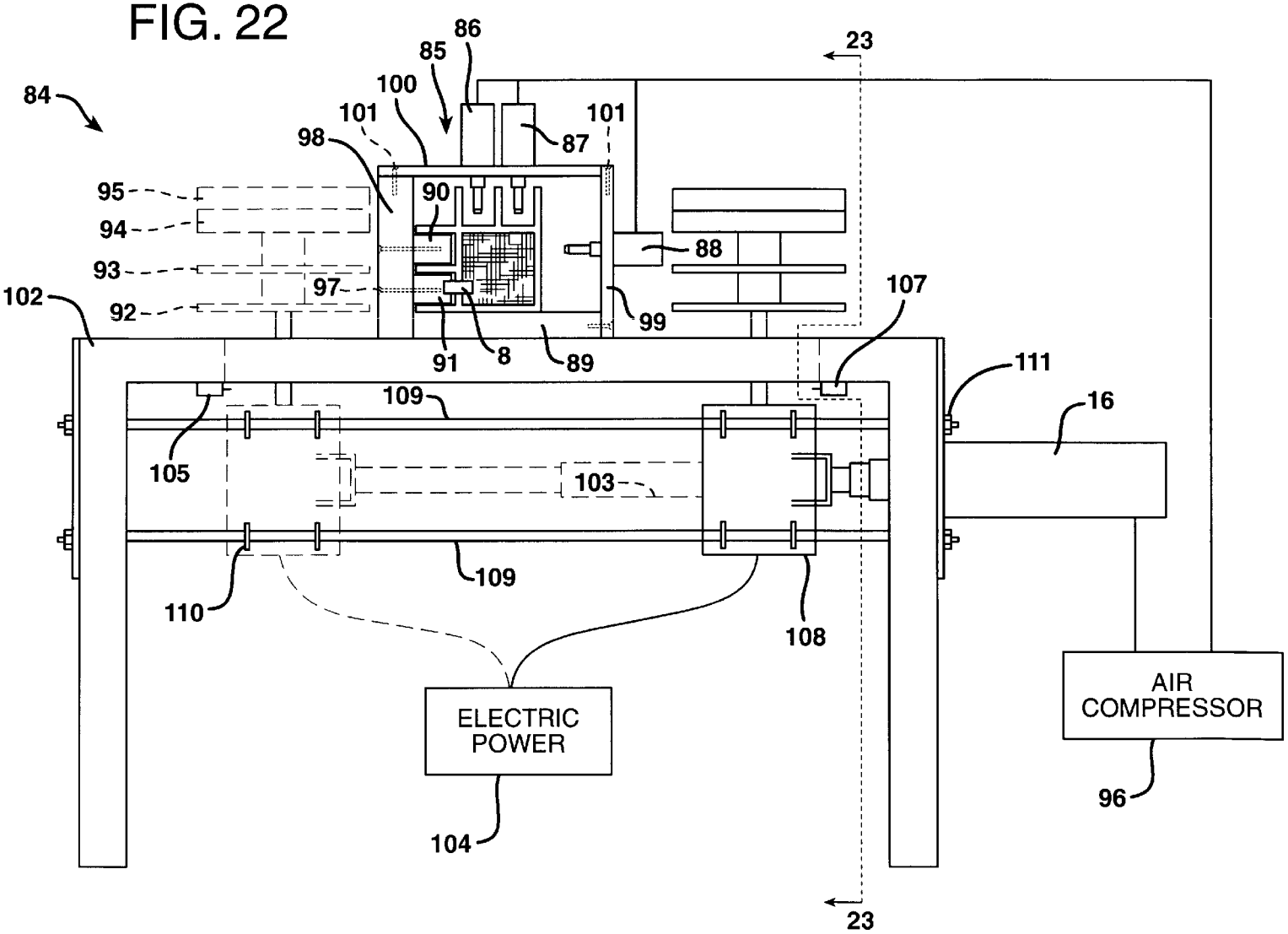
FIG. 22 is an end view of the notch mill machine.
Figure 23:
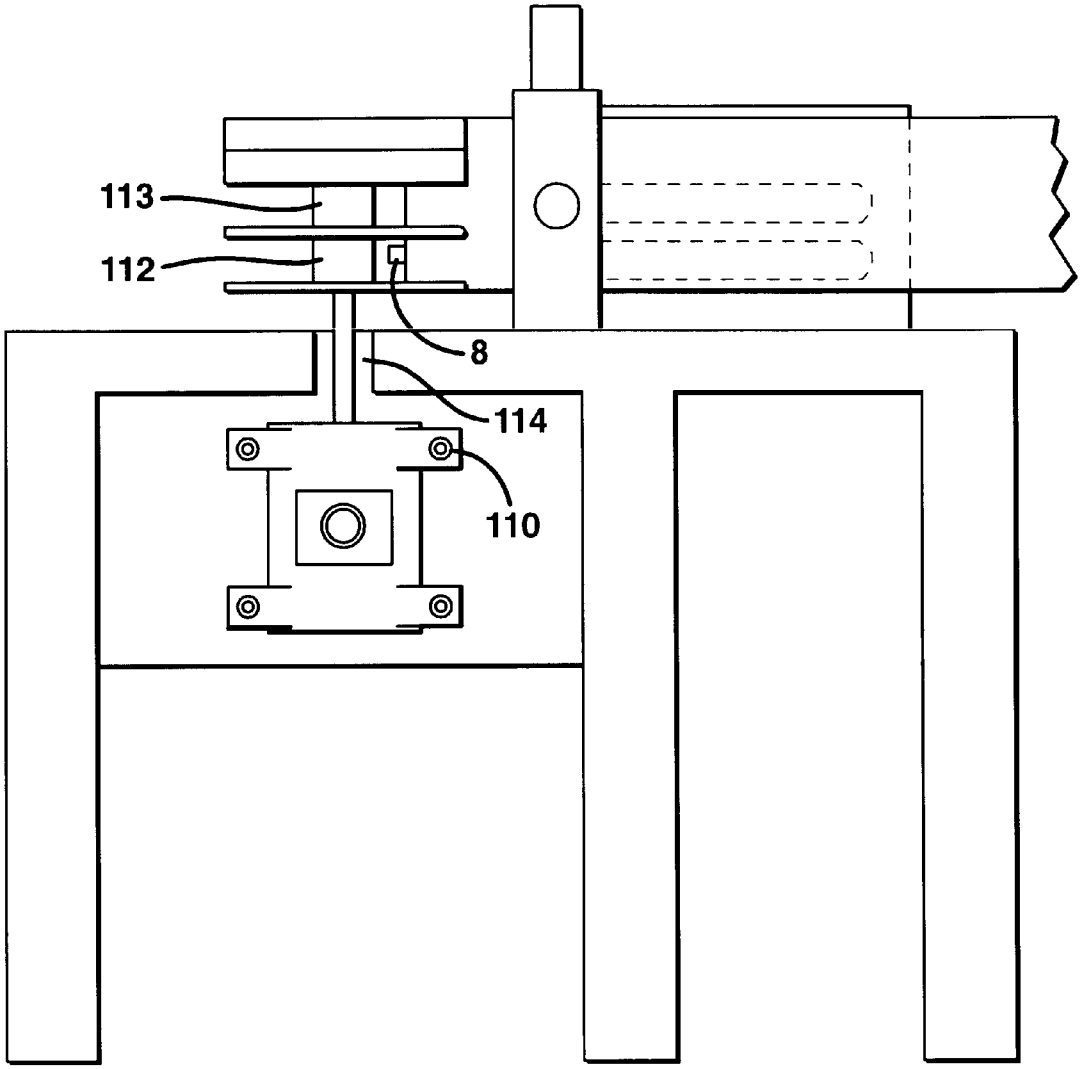
FIG. 23 is a side view of the notch mill machine.
Figure 24:
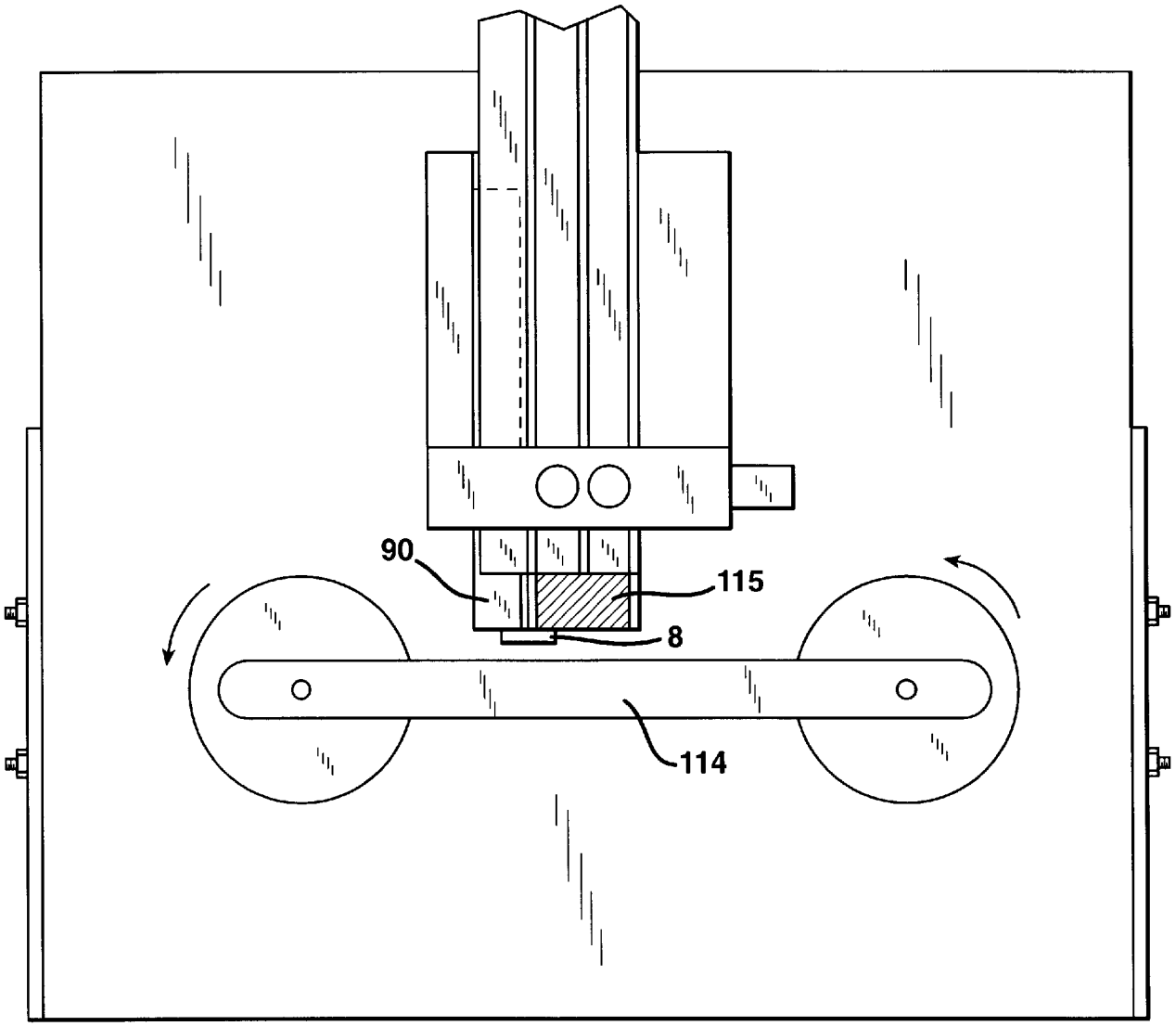
FIG. 24 is a plan view of the notch mill machine.

The structure and functioning of the notch mill machine 84 is described with reference to FIGS. 22–33. FIG. 22 shows the front view of a notch mill machine according to an exemplary embodiment of the invention. A reinforced corner post is shown positioned in the notch guide 85 prior to supplying air pressure to the two vertical pneumatic actuated clamps 86, 87 and single side pneumatic actuated clamp 88. The reinforced corner post is positioned so that the guide rails 90, 91 of the notch guide protrude into the adjacent window tracks defined by the horizontally disposed set of ridges on the corner post. The corner post is advanced towards the cutting blades until further passage of the post is prevented by notch mill stop 8. As can be seen in FIGS. 22–24, the notch mill stop is positioned such that it abuts the end of the corner post, but does not interfere with travel of the saw blades. For example, the notch mill stop may be welded or otherwise fastened to, or form an integral part of, one or more of the guide rails 90, 91. The notch mill stop is positioned relative to the saw blade cutting path so that the blades cut into the corner post end to the desired depth. Preferably, the desired depth is the height of the medial ridge extending away from the tube wall.

The clamps 86, 87, 88 firmly compress the top and side of the corner post against the notch guide base 89 and guide rails 90, 91, respectively. The clamps are shown in the non-gripping position. The clamps would press up against the profile upon actuation of the clamp pneumatic cylinders. The clamps hold the comer post end steady as the traversing saw blades 92–95 provide a notch in the reinforced comer post end. The clamps are energized by a conventional air compressor 96. The pneumatic regulators and valves characteristic of such systems are widely known in the industry and do not need to be described further.

The notch guide rails are attached to the notch guide by notch guide rail fasteners 97. The notch guide assembly includes the rails support 98, side clamp support 99, and top clamp support 100. Each of these portions of the notch guide are assembled together using appropriate guide segment fasteners 101. The guide assembly is securely fastened to notch mill table 102 by similarly appropriate fasteners (not shown). The top clamp support of the notch guide is elevated a sufficient distance so that the corner post end can be inserted into the cutting zone.

The guide rails are substantially parallel to each other. The guide rails occupy the window tracks as in the case of the corner post shown in FIG. 22.

In response to activation by a convenient start switch, such as a foot pedal (not shown), the air compressor pressurizes the piston 103 using saw blade actuator 106 to push the traversing saw blade assembly past the corner post end, as best shown in FIG. 23. In doing so, a series of four rotating cutting blades perform the desired cuts in the corner post end. In FIG. 22, the saw blades are represented in a purely schematic manner.

Standard electrical connections are provided by the electrical power box 104. Upon passing and cutting the corner post end through the first traverse, the saw blade trips a far limit switch 105 which releases pneumatic actuation pressure on the pneumatic actuator. A return spring (not shown), or other conventional mechanism, returns the traversing saw blade for a follow-up pass and ensure a clean cut. Upon the saw blade's return to its initial position, a near limit switch 107 shuts off the electrical power and releases air supplied to the clamp actuators.

The traversing motor 108 is mounted on any conventional mechanism for suitably supporting the motor and saw blade through its cycle. One such system is a plurality of parallel motor support rods 109 placed through correspondingly positioned motor casing opening 110. The support rods are securely fastened to the table by rod fasteners 111.

At the end of the rotating shaft are four stacked cutting blades. The lowest blade 92 removes the tube wall and the lower of the two horizontally directed lateral ridges lying below the reinforcing insert. This removed portion will ultimately receive another structural component's lateral ridge. Insofar as the top of the lateral ridges have a flat rather than curved contour, the cut provided by this blade is square to provide a flat cut surface. The next higher blade 93 cuts the notch which will ultimately receive another structural member's medial ridge. As noted previously, the contour provided by this blade at the bottom of the notch cut is concave to complement the convex contour of the top of the medial ridges as explained below. The two lowermost blades are separated by a lower spacer 112. The uppermost pair of cutting blades is comprised of a lower paired blade 94 and an upper paired blade 95. The notch-cutting blade and the lower paired blade are spaced apart by an upper spacer 113. These two blades remove not only the corner post's portion of the tube wall lying above the reinforcing insert, but also the upwardly directed medial ridge and lateral ridges. Like the lowest blade, a square cut is provided by these paired blades.

The FIG. 23 side view of the notch mill machine is taken along line 23–23 of FIG. 22. The saw shaft extends up through an oblong opening 114 in the saw table. The notch guide rails can be seen in phantom lying behind the corner post. The spacing between the notch guide rails receives the horizontally directed medial ridge of the corner post.

FIG. 24 is a top view of the notch mill machine showing the counterclockwise rotation of the cutting blades. The notched end of the corner post is shown after a single notch has been provided in the corner post. That is, the cross cut described below has not yet been made. An exposed portion 115 of the reinforcing insert can be seen.

Figure 25:
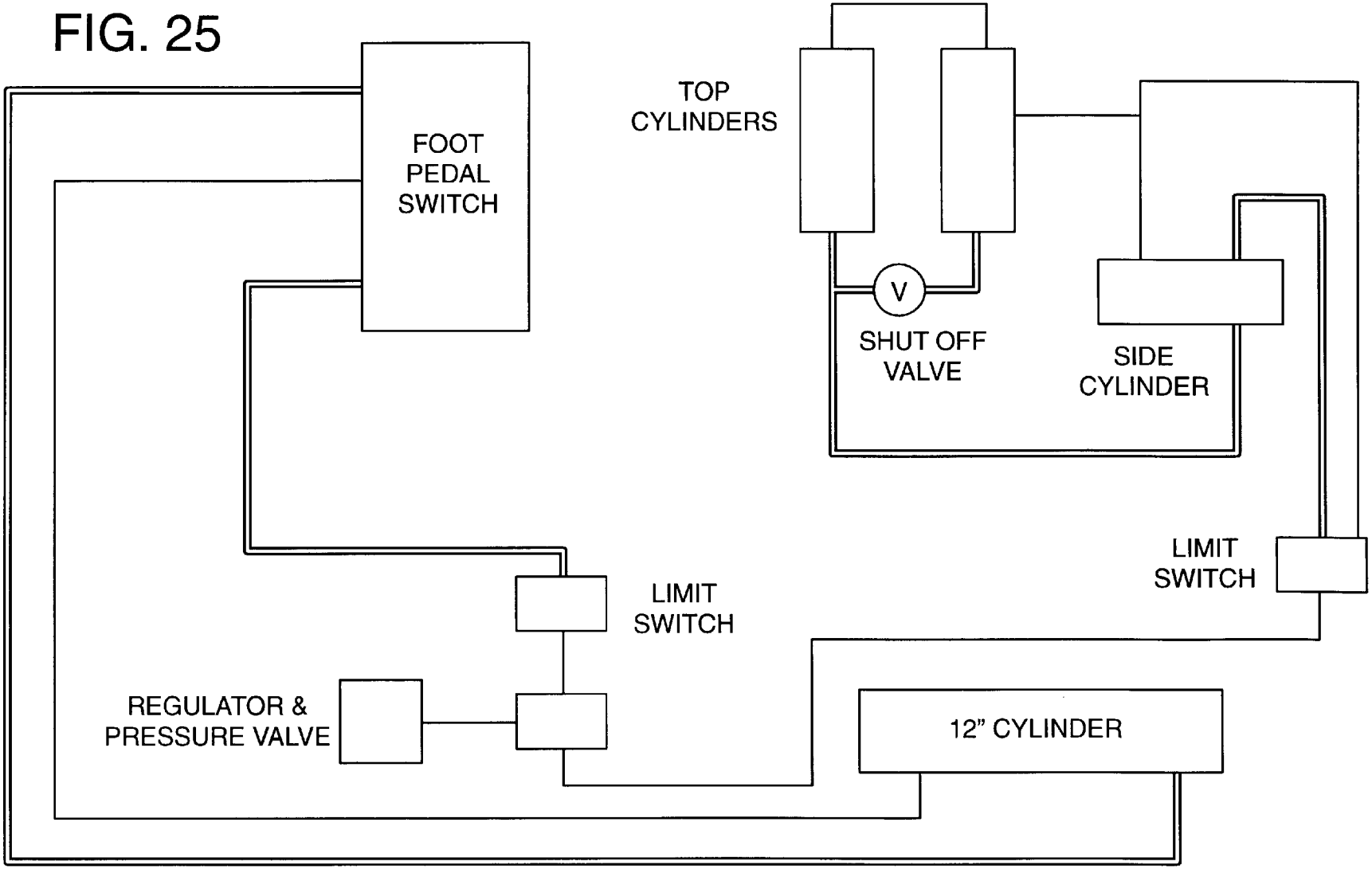
FIG. 25 is a schematic of the pneumatic system.

FIG. 25 is a schematic of the pneumatic system controlling operation of the saw. Compressed air and electrical power are provided to the notch mill. The machine operator first places the corner post in the notch guide. Once the end of the corner post is properly aligned with the blades, electrical power is supplied to the motor and the foot pedal is depressed. The pedal switch admits compressed air to the clamp actuators thereby firmly compressing the corner post against the notch guide. Air also actuates the larger cylinder actuator that moves the motor through its first pass cutting the post end. Upon reaching and tripping the far limit switch, air pressure is released from only the larger motor actuator thereby allowing the cylinder's return springs to cause the blades to pass the corner post end again for a second cut. The clamps remain under pressure throughout this period. The electric motor is shut down and the clamping pressure removed once the saw motor trips a second near limit switch located at the saw's original position.

Figure 22A:
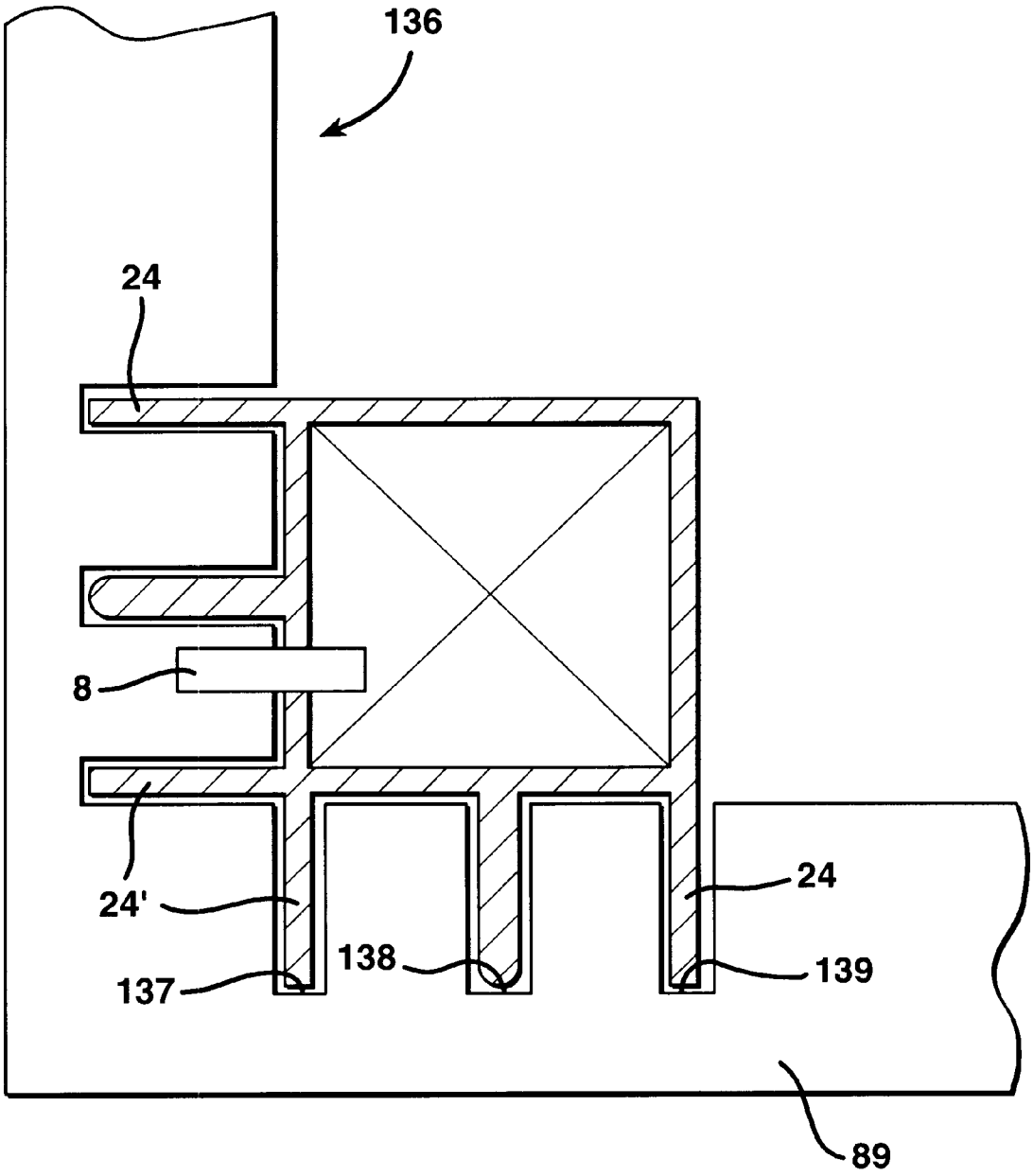
FIG. 22A is an end view of an alternative notch guide.

After the first notch is made in the corner post, the corner post is rotated 90 degrees along its axis and repositioned in the notch guide for making the cross cut. The corner post could be rotated 90 degrees clockwise with respect to its orientation as shown in FIG. 22 and re-clamped for making the cross-cut. An alternative notch guide 136 could also be used, as shown in FIG. 22A. The base 89 of the alternative notch guide 136 differs from that of the notch guide 85 shown in FIG. 22 in that the former includes base grooves 137–139 for receiving two lateral ridges and a medial ridge on one side of the corner post. Using the alternative notch guide enables 90 degree rotation of the corner post in either the clockwise or counterclockwise direction in order to make the cross-cut.

Figure 26:
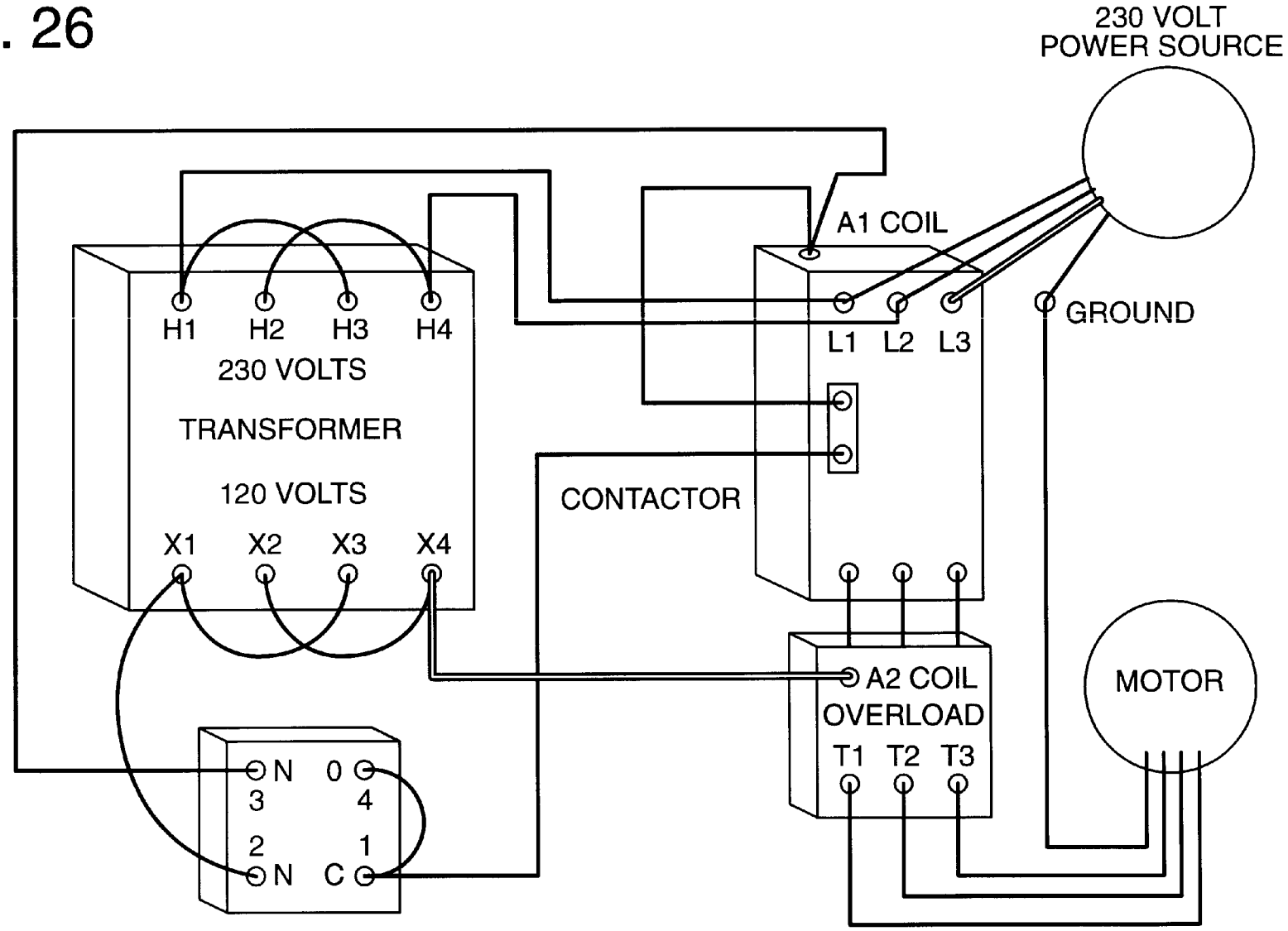
FIG. 26 is an electrical schematic diagram.

FIG. 26 shows an electrical schematic for supplying power to the notch mill.

Figure 27:
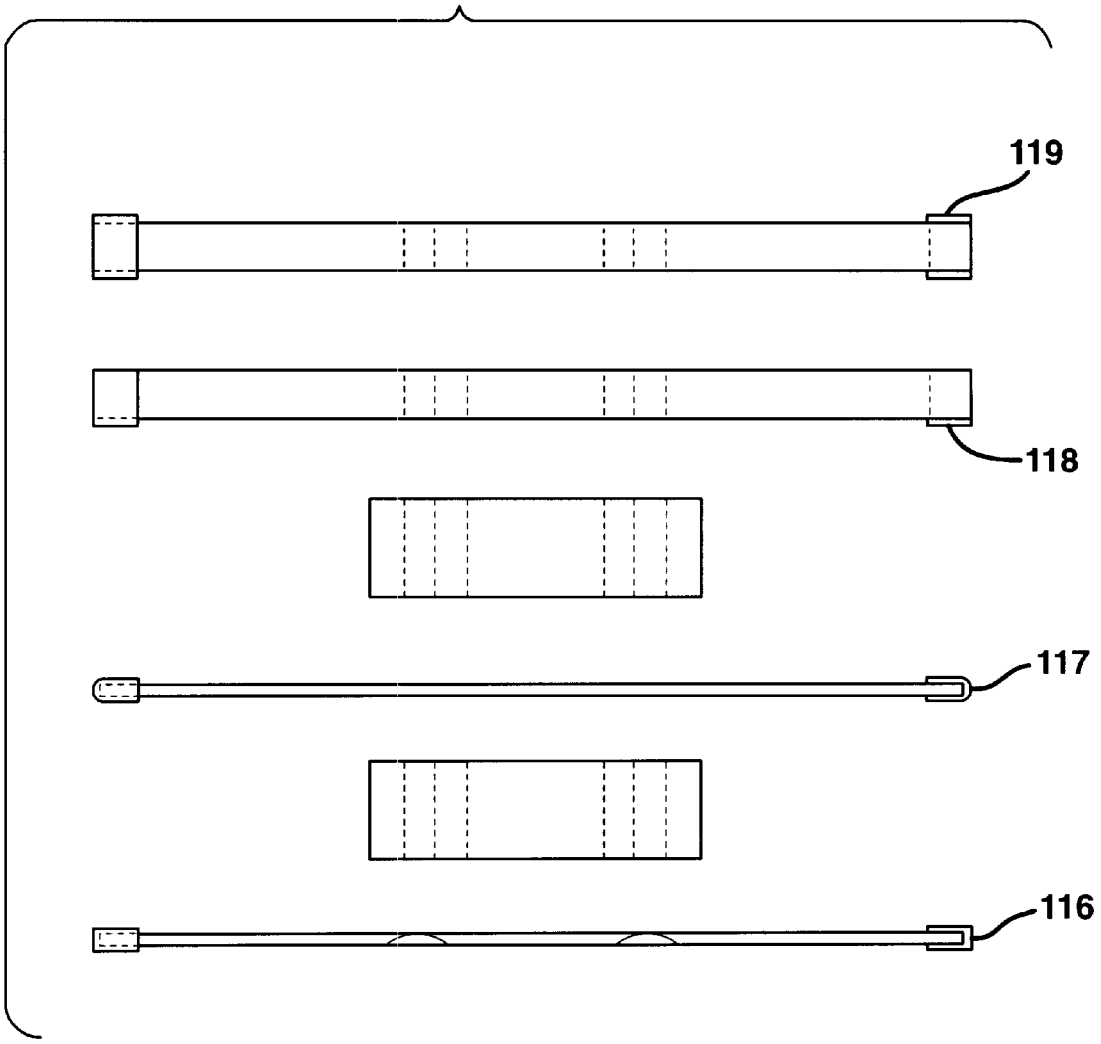
FIG. 27 is an exploded side view of the saw blade assembly.
Figure 28:
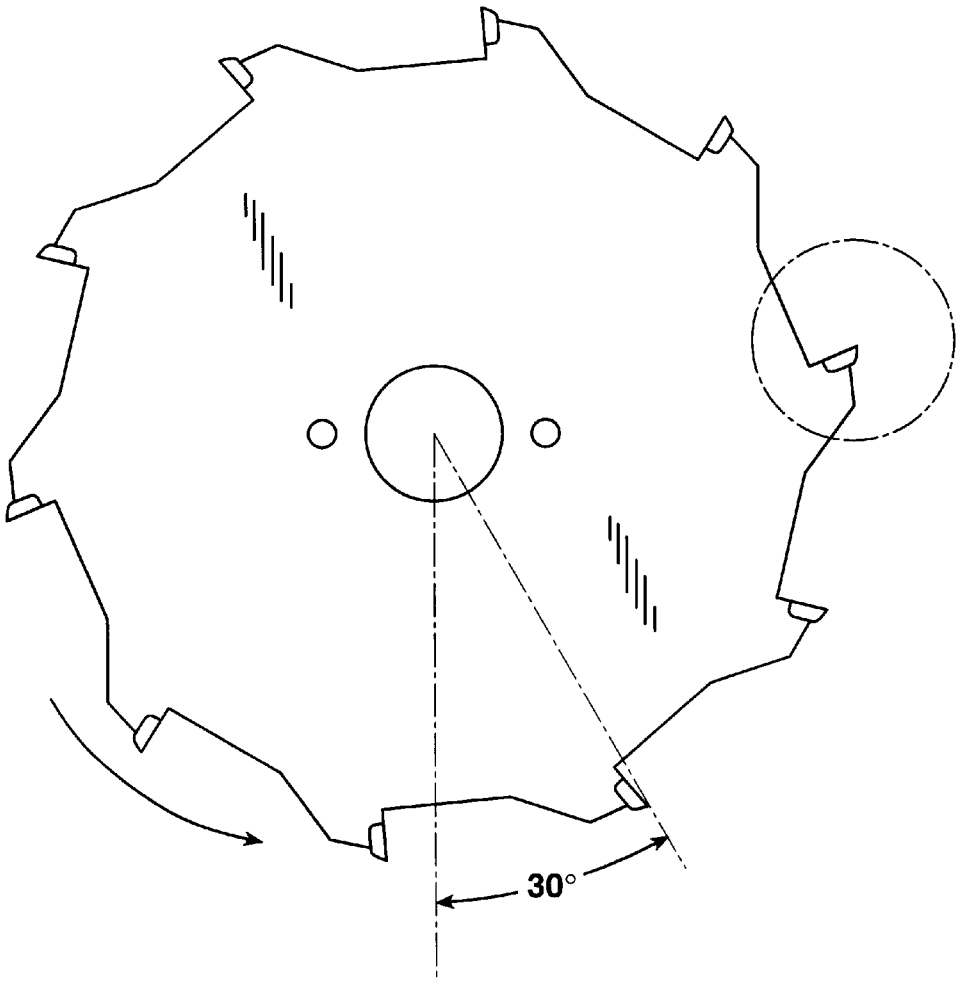
FIG. 28–33 are views of the saw blades.

FIG. 27 is a more detailed view of the four blades used by the notch mill machine. This view is a view taken along a line that advances 10 degree in rotation with each blade in light of the 10 degree rotational offset of one blade tooth to the next as shown in FIG. 28–FIG. 31. As shown by carbide cutting tips 118–119, the lowermost blade and two uppermost blades provide a square or flat contour to the cuts made by these blade. The blade which provides the notch cuts has a rounded or convex contour cutting tip 118 so that a concave contour is imparted to the bottom of the notch. As noted previously, the concave contour complements to convex contour of the medial ridges.

Figure 29:
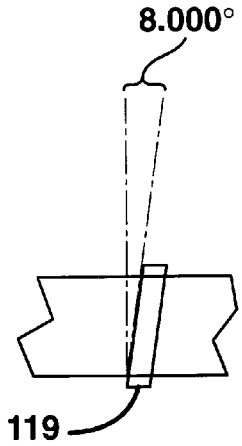
Figure 30:
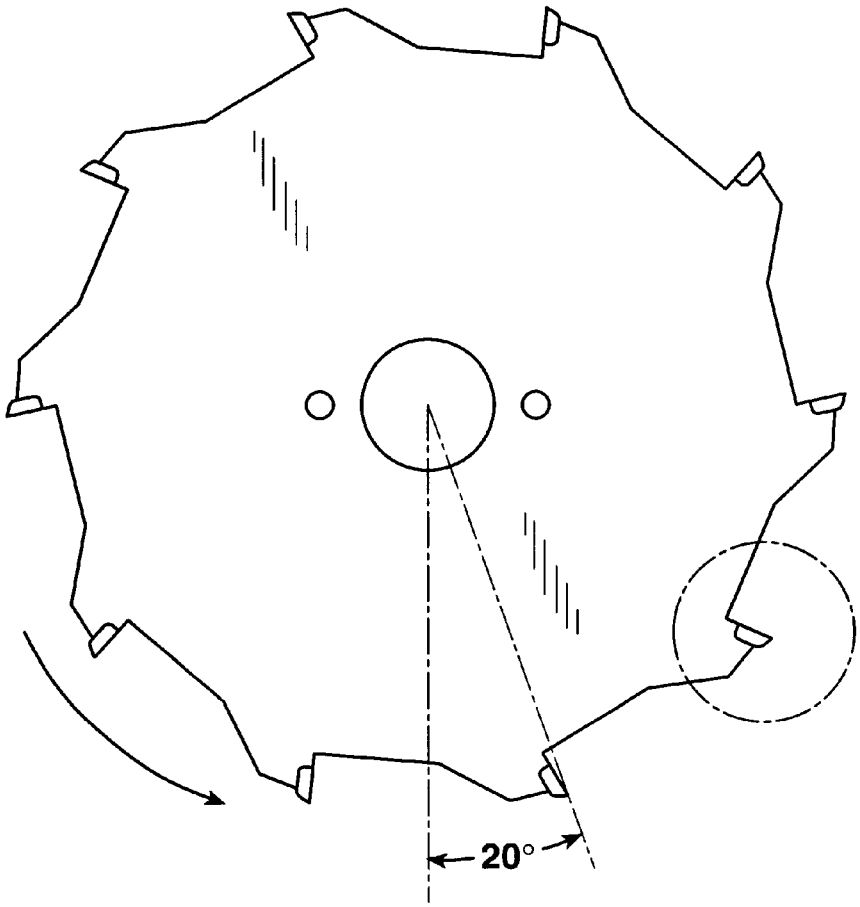
Figure 31:
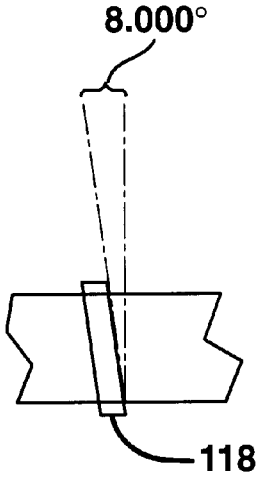
Figure 32:
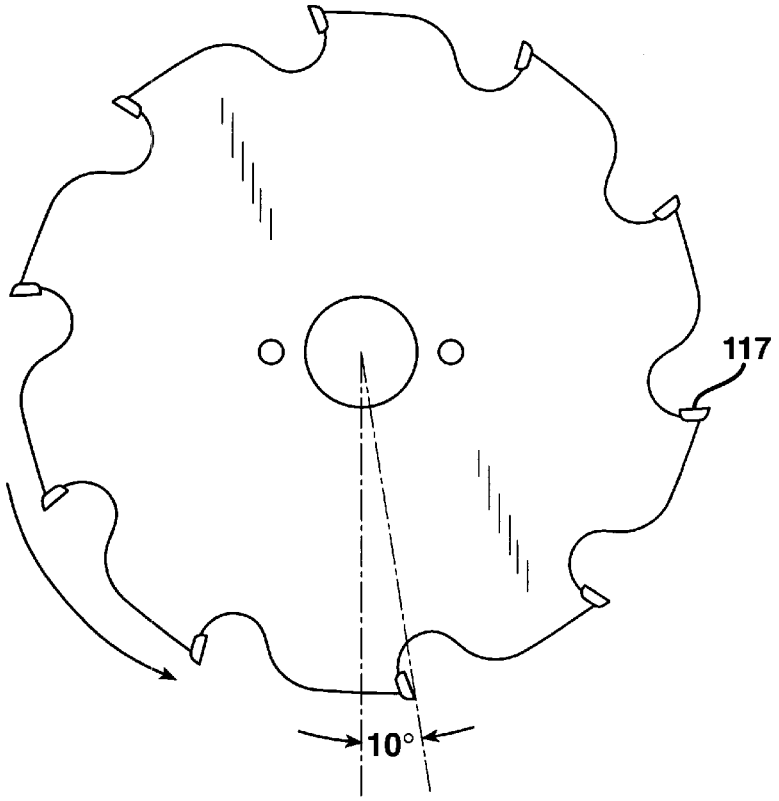
Figure 33:
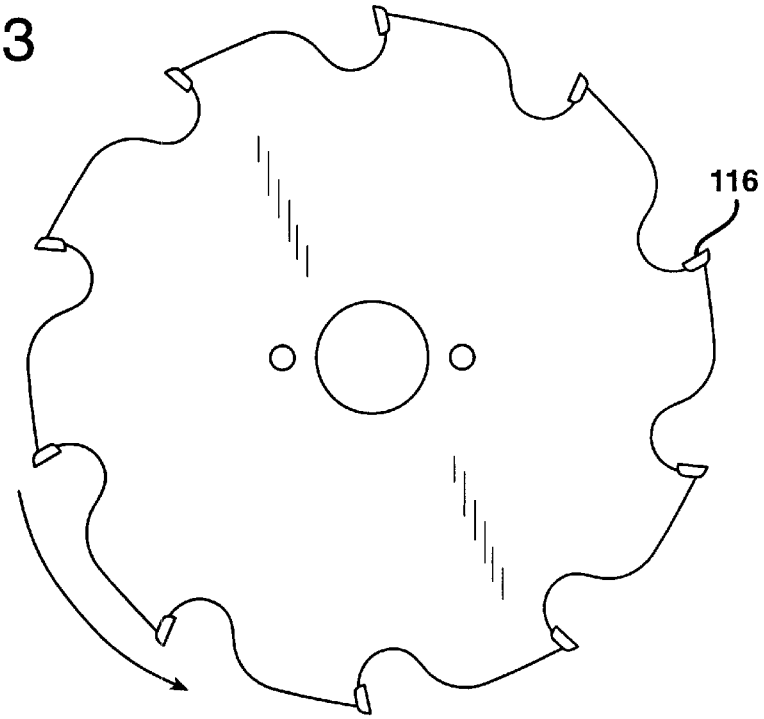

FIG. 28, FIG. 30, FIG. 32, FIG. 33 are plan views of cutting blades 95, 94, 93, 92, respectively. As noted on each of these viewed together, the alignment of the cutting tips advances 10 degrees one blade to the next. Hence, no two adjacent cutting tips are vertically aligned. Detail FIG. 29 and FIG. 31 show that the cutting tips 119, 118 of the upper and lower blades of the paired blades are angled 8 degrees forward and 8 degrees backward, respectively. It is believed that this design minimizes chipping of the vertically directed medial and lateral ridges when the post is oriented in the notch guide as depicted in FIG. 22. While carbide cutting tips are preferred, other types can be used as well.

Returning to the assembly method, A kick plate is set into the wall and floor starter so that the medial ridge of the starters between the two channels fits snuggly into the kerf of the kick plate. A jamb post is erected by inserting the bottom notched end of the post into the channels of the floor starter and seated snuggly against the kick plate that was previously installed. Again, the medial ridge of the jamb post is fitted snuggly into the kerf of the kick plate. This operation is continued around the remainder of the room, except where the door is positioned, whilst replacing the jamb posts with corner posts at the corners of the enclosure. The corner post is provided a cross-cut notch at its bottom end by the notch mill machine. An L-bracket or other appropriate hardware is used for supporting all joints as described previously. Where the door is positioned, door jambs are erected on both sides of the break in the floor starter. The door jambs do not fit into the starter but extend entirely to the substrate. Accordingly, door jambs use a longer screen track removal distance "x" than the other vertical posts. The floor starter and the door jambs may be secured together by means of screw fasteners.

Figure 20:
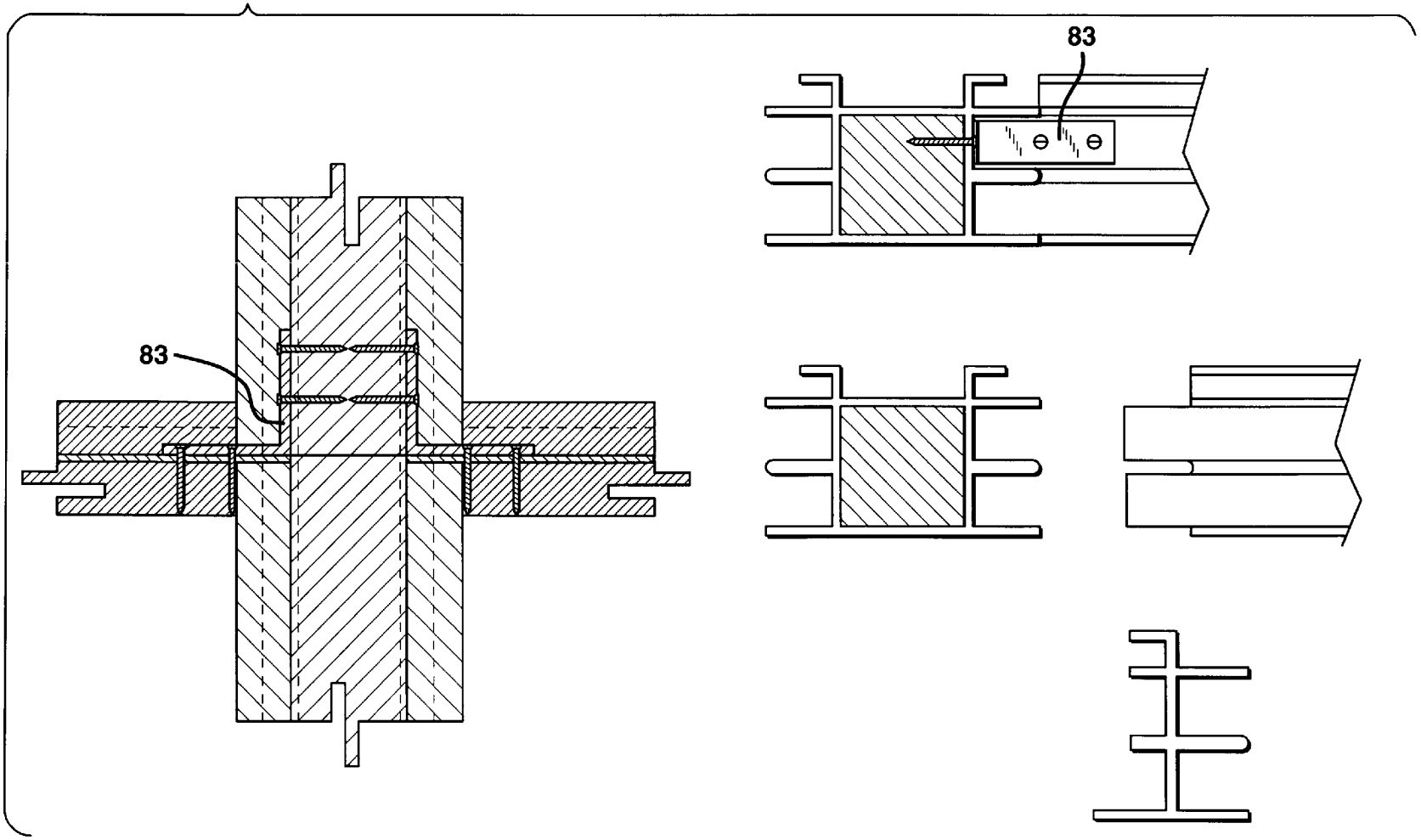
FIG. 20 shows various views of the sill to jamb post joint.

In a manner similar to the interfitting of the kick plate and the floor starter, the sill is placed over and interfitted with the top edge of the installed kick plate such that the sill's downwardly directed medial ridge is inserted into the kick plate kerf, as shown in FIG. 3. Like the bottom edge, the top edge of the kick plate fits snug in the sill tracks defined by the lateral ridges. Each end of the sill is machined by the notch mill machine so that the sill can interfit with the two adjacent uprights. The notched end of the sill rail is shown in FIG. 20. As in the case of the joint between the wall starter and the floor starter, the bottom of the notch includes a concave contour provided by the cutting blade of the notch mill. The concave notch contour complements the convex contour of the medial ridges against which it abuts. In this manner, the joint is especially well complementary thereby adding to overall structural integrity of the assembled enclosure.

Once the kick plate and sill has been installed, the sill and the two uprights to either side of the sill are preferably securely fastened together with conventional hardware, such as L-angle brackets 83 and threaded screws, as shown in FIG. 20.

After the uprights, kick plates, and sills are in place, the side headers are then installed. Beginning with the header base extrusion, the notched end of the header is inserted into the channels of the wall starter. The opposite notched end of the header is inserted into the channels of the corner post. Consequently, the notches on the erect jamb posts fit closely into the channels located on the bottoms of the header. L-brackets or other appropriate hardware is used at the joints of headers and vertical posts as well. The wood filled header is installed in the same manner as the side headers, but the wood filled header is installed between two posts.

Figure 21:
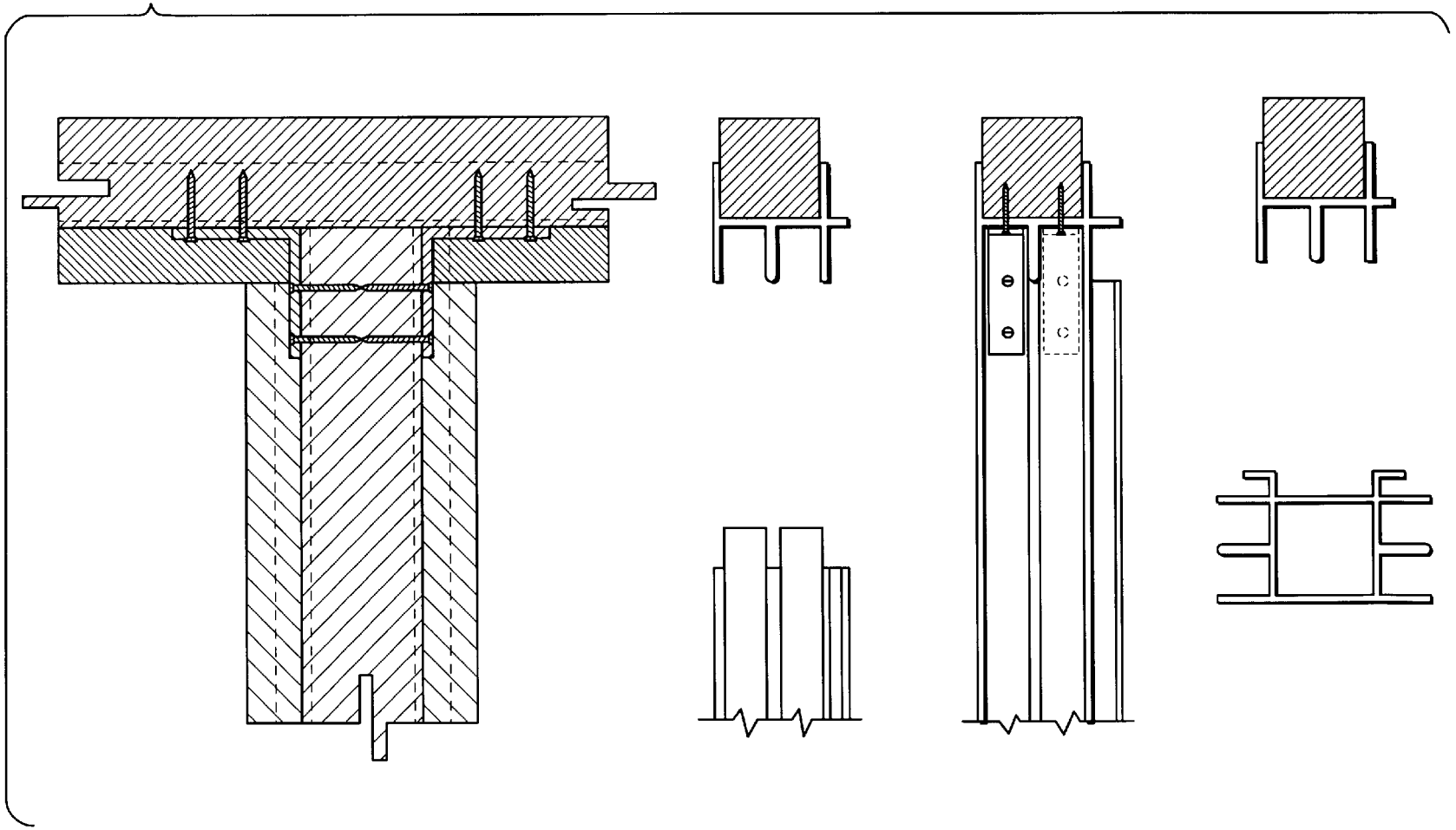
FIG. 21 shows various views of the header to jamb post joint.

A front header 11 is set into and securely attached to the enclosure wall above each window unit and corner post, jamb post, and wall starter post along the length of the enclosure. As shown in FIG. 21, the header includes downwardly projecting ridges defining two adjacent window tracks similar in structure and function the window tracks of the sill rail. The upwardly projecting side of the front header however, is different from the sill rail in that it preferably does not include a medial ridge so that a header insert may be laid and secured to a single upwardly disposed "U"-shaped header groove. The purpose of the header insert is to provide structural support for the ends of the roof panels furthest from the existing structure. The header insert preferably extends above the upwardly projecting header lateral ridges so that an F-channel member may be received on top of the header insert.

On the sides of the enclosure, gable end filler panels are installed into the wall starter and side headers in the same manner as the kick plates fit into the wall and floor starters. With the proper orientation, the filler panels are placed into the wall starters and headers by inserting the medial ridge of the starter and header into the kerf in the expanded polystyrene foam of the filler panel. An F-channel is then placed on the top edge of both the filler panel and the side header. Finally, a roof is installed overlying the framework per the manufacturer's installation instructions.

An enclosure made according to the invention is designed for one story applications not exceeding 12 feet in height. Table 2 shows the allowable beam span for screen rooms with solid roofs. Screen rooms are rooms having screens, but no glass windows. Table 3 shows the allowable upright heights for screen and vinyl rooms (TIMBERSTRAND in vinyl sheathing). Table 4 shows the allowable spans for roof pan panel products for various loads. Table 5 shows the allowable spans for industry standard composite roof panels.

TABLE 2

| | Allowable Beam Span - Screen Rooms With Solid Roofs Timber Strand in Vinyl Sheathing | | | | |
|---|---|---|---|---|---|
| | Wind Zone = | | | | |
| | 102 MPH | 110 MPH | 120 MPH | 125 MPH | 140 MPH |
| | Applied Load = | | | | |
| | 17#/Sq. Ft. | 20#/Sq. Ft. | 23#/Sq. Ft. | 26#/Sq. Ft. | 32#/Sq. Ft. |
| Load Width | 1.75" × 1.75" MOE 1,500 ksi | | | | |
| 5' | 4'–5" | 4'–1" | 3'–10" | 3'–7" | 3'–3" |
| 6' | 4'–1" | 3'–9" | 3'–6" | 3'–3" | 2'–11" |
| 7' | 3'–9" | 3'–5" | 3'–3" | 3'–0" | 2'–9" |
| 8' | 3'–6" | 3'–3" | 3'–0" | 2'–10" | 2'–7" |
| 9' | 3'–4" | 3'–1" | 2'–10" | 2'–8" | 2'–5" |
| 10' | 3'–2" | 2'–11" | 2'–8" | 2'–6" | 2'–3" |
| 11' | 2'–11" | 2'–9" | 2'–7" | 2'–5" | 2'–2" |
| 12' | 2'–10" | 2'–8" | 2'–6" | 2'–4" | 2'–1" |

Example:

Header beam span is distance between uprights to enter table find load width using roof panel projection of (14'–0"/2 + Over Hang Width)

(LW = (14'/2 + 2' Over Hang) = 9') Enter table on left under load width

Load width = 9'–0" and read span under appropriate load

Live Load @ 17#/Sq. Ft./102 MPH Load Beam Span = 3'–4"

TABLE 3

Allowable Upright Heights for Screen and Vinyl Rooms
Timber Strand in Vinyl Sheathing
1.75 " × 1.75 " MOE 1,500 ksi

| | Wind Zone = | | | | |
|---|---|---|---|---|---|
| | 102 MPH | 110 MPH | 120 MPH | 125 MPH | 140 MPH |
| | Applied Load = | | | | |
| Load Width | 17#/Sq. Ft. | 20#/Sq. Ft. | 23#/Sq. Ft. | 26#/Sq. Ft. | 32#/Sq. Ft. |
| 24" | 12'–10" | 11'–10" | 11'–0" | 10"–4" | 9'–4" |
| 30" | 11'–6" | 10'–7" | 9'–10" | 9'–3" | 8'–4" |
| 36" | 10'–6" | 9'–8" | 8'–11" | 8'–6" | 7'–7" |
| 42" | 9'–8" | 8'–11" | 8'–4" | 7'–10" | 7'–1" |
| 48" | 9'–1" | 8'–4" | 7'–9" | 7'–4" | 6'–7" |

Kick Panel Sill is at 24" Height
Notes: Using screen panel width "w" (see typical room drawing) select upright required from the maximum height allowed for each wind and/or applied load required by code.

TABLE 4

Allowable Spans for Roof Pan Panel Products for Various Loads
Industry Standard Products 3105 H-14 or H-25 Aluminum Alloy
Vinyl Screen Rooms

| | | Overhang Condition | | | | |
|---|---|---|---|---|---|---|
| Wind Region | Applied Load | NONE | 1'–0" | 2'–0" | 3'–0" | 4'–0" |
| | | 3" × 12" × 0.019" Panels | | | | |
| 102 MPH | 17 | 10'–11" | 11'–2" | 11'–8" | 12'–6" | 13'–7" |
| 110 MPH | 20 | 10'–0" | 10'–4" | 10'–10" | 11'–9" | 12'–11" |
| 120 MPH | 23 | 9'–5" | 9'–8" | 10'–3" | 11'–2 | 12'–4" |
| 125 MPH | 26 | 8'–10" | 9'–1" | 9'–9" | 10'–8" | 11'–11" |
| 140 MPH | 32 | 7'–11" | 8'–3" | 8'–11" | 9'–11" | 11'–4" |
| | | 3" × 12" × 0.026" Panels | | | | |
| 102 MPH | 17 | 13'–11" | 14'–1" | 14'–6" | 15'–2" | 16'–0" |
| 110 MPH | 20 | 12'–10" | 12'–11" | 13'–5" | 14'–2" | 15'–1" |
| 125 MPH | 23 | 11'–11" | 12'–1" | 12'–7" | 13'–4" | 14'–5" |
| 120 MPH | 26 | 11'–3" | 11'–5" | 11'–11" | 12'–9" | 13'–10" |
| 140 MPH | 32 | 10'–2" | 10'–4" | 10'–11" | 11'–9" | 12'–11" |
| | | 3" × 12" × 0.032" Panels | | | | |
| 102 MPH | 17 | 15'–5" | 15'–6" | 15'–11" | 16'–6" | 17'–4" |
| 110 MPH | 20 | 14'–2" | 14'–4" | 14'–9" | 15'–5" | 16'–3" |
| 120 MPH | 23 | 13'–3" | 13'–5" | 13'–10" | 14'–6" | 15'–6" |
| 125 MPH | 26 | 12'–5" | 12'–7" | 13'–1" | 13'–10" | 14'–10" |
| 140 MPH | 32 | 11'–3" | 11'–5" | 11'–11" | 12'–9" | 13'–9" |

Note: Total roof panel width = room projection + wall width + overhang

TABLE 5

Allowable Spans for Industry Standard Composite Roof Panels
Aluminum Alloy 3105 H-14 or H-25 1.0 EPS Core Density Foam
Vinyl Screen Rooms

| | | Overhang Condition | | | | |
|---|---|---|---|---|---|---|
| Wind Region | Applied Load | NONE | 1'–0" | 2'–0" | 3'–0" | 4'–0" |
| | | 3" × 48" × 0.019" Panels | | | | |
| 102 MPH | 17 | 13'–6" | 13'–8" | 14'–1" | 14'–10" | 15'–9" |
| 110 MPH | 20 | 12'–6" | 12'–8" | 13'–1" | 13'–10" | 14'–10" |
| 120 MPH | 23 | 11'–8" | 11'–10" | 12'–4" | 13'–1" | 14'–1" |
| 125 MPH | 26 | 10'–11" | 11'–2" | 11'–8" | 12'–6" | 13'–7" |
| 140 MPH | 32 | 9'–10" | 10'–1" | 10'–8" | 11'–7" | 12'–8" |
| | | 3" × 48" × 0.024" Panels | | | | |
| 102 MPH | 17 | 16'–0" | 16'–2" | 16'–6" | 17'–1" | 17'–11" |
| 110 MPH | 20 | 14'–9" | 14'–11" | 15'–4" | 15'–11" | 16'–10" |

TABLE 5-continued

| Allowable Spans for Industry Standard Composite Roof Panels Aluminum Alloy 3105 H-14 or H-25 1.0 EPS Core Density Foam Vinyl Screen Rooms | | | | | | |
|---|---|---|---|---|---|---|
| | | Overhang Condition | | | | |
| Wind Region | Applied Load | NONE | 1'–0" | 2'–0" | 3'–0" | 4'–0" |
| 120 MPH | 23 | 13'–9" | 13'–11" | 14'–4" | 15'–0" | 15'–11" |
| 125 MPH | 26 | 12'–11" | 13'–1" | 13'–7" | 14'–3" | 15'–3" |
| 140 MPH | 32 | 11'–8" | 11'–10" | 12'–4" | 13'–2" | 14'–2" |
| | | 3" × 48" × 0.030" Panels | | | | |
| 102 MPH | 17 | 17'–11" | 18'–0" | 18'–4" | 18'–11" | 19'–7" |
| 110 MPH | 20 | 16'–6" | 18'–7" | 16'–11" | 17'–7" | 18'–4" |
| 120 MPH | 23 | 15'–5" | 15'–6" | 15'–11" | 16'–6" | 17'–4" |
| 125 MPH | 26 | 14'–6" | 14'–7" | 15'–0" | 15'–8" | 16'–6" |
| 140 MPH | 32 | 13'–1" | 13'–2" | 13'–8" | 14'–4" | 15'–4" |

Note: Total roof panel width = room projection + wall width + overhang

A wall panel constructed from three sections was tested according to ASTM E 547-93 ("Standard Test Method for Water Penetration of Exterior Windows, Curtain Walls, and Doros by Cyclic Static Air Pressure Differential") and ASTM E 330-96 ("Standard Test Method for Structural Performance of Exterior Windows, Curtain Walls, and Doors by Uniform Static Air Pressure Difference"). The overall size of the wall panel was 10'7" wide by 7'4" high. The finish was white PVC. Each end section of the wall panel contained two window sashes. Each end window sash was 1'6¼" wide by 4'11" high. Each of the two middle section window sashes were 2'0¼" wide and 4'11" high. Weatherstripping included a single row of 0.125" wide by 0.200" high vinyl wrapped foam bulb on all sills and interior meeting stiles as well as an adhesive backed 0.300" diameter flexible bulb on each jamb. The wall panel frame was constructed of oriented strand board reinforced PVC members in accordance with the invention. The sills were constructed of unreinforced PVC members, also in accordance with this invention. All corners were pressure fit and sealed with silicone. The 1.75" thick kick plates were constructed of two 0.055" thick PVC sheets glued to an expanded polystyrene core. The panels were pressure fit to the frame and sealed on the interior and exterior with silicone. The window sash sets were constructed using conventional PVC extruded frame material mitered and glued at the corners and fastened with one screw per corner. The meeting stiles were reinforced with 0.050" thick formed steel members. PVC glazing adapters were snapped into each member. Underneath each window sash were two plastic guide buttons each spaced 1⅜" from each end of the bottom rail of each sash. The meeting rails of each sash set were provided with two conventional metal sweep cam locks on the interior meeting rail and two complementary metal keepers on the exterior meeting rail each one being 14" from the meeting rail ends. Each center leg and each exterior leg of the sill was provided with two 1.085" wide by 0.125" high weepslots for drainage. The bottom of each sill screen track was provided with two 0.960" wide by 0.165" high weep holes for drainage.

In the "single pane" test sample, each sash was constructed of a single sheet of 0.122" thick clear annealed glass. On the interior surface of the glass, a 0.012" thick plastic laminate was used. The glass was channel glazed with a flexible U-shaped gasket. In the "sealed glass" case, 0.500" thick sealed insulating glass fabricated from two 0.122" thick clear sheets of annealed glass and an aluminum reinforced desiccant matrix spacer system was used. The insulating glass was channel glazed into silicone bedding.

With respect to the water penetration test ASTM E 547-93, there was no leakage for either the single pane or the sealed glass test sample at a WTP (water test pressure) of 2.86 psf (pounds-per-square-foot). The structural performance ASTM E 330 test results are tabulated in Table 6 below.

TABLE 6

| Structural Test Results | Deflection | Permanent Set |
|---|---|---|
| Single Pane | | |
| @ +30 psf held for 29 seconds | | |
| Vertical mullion | 1.730" | 0.140" |
| Meeting stile | 3.114" | 0.104" |
| Panel | 0.086" | 0.005" |
| @ −30 psf held for 29 seconds | | |
| Vertical mullion | 1.650" | 0.157" |
| Meeting stile | 2.292" | 0.295" |
| Panel | 0.020" | <0.001" |
| Sealed Glass | | |
| @ +40 psf held for 29 seconds | | |
| Vertical mullion | 3.309" | 0.105" |
| Meeting stile | 2.725" | 0.173" |
| Panel | 0.405" | 0.006" |
| @ −40 psf held for 29 seconds | | |
| Vertical mullion | 2.793" | 0.065" |
| Meeting stile | 2.639" | 0.163" |
| Panel | 0.149" | 0.001" |

Weep holes are preferably provided in the sills through each of the sill exterior lateral ridges and the medial ridge so that rain water and melting snow and ice draining off the windows into the interior and exterior track will drain to the outside. No holes or other breaches to the structural integrity of the interior lateral ridge should be permitted so that water does not drain off the windows into the enclosed space.

Figure 34B:
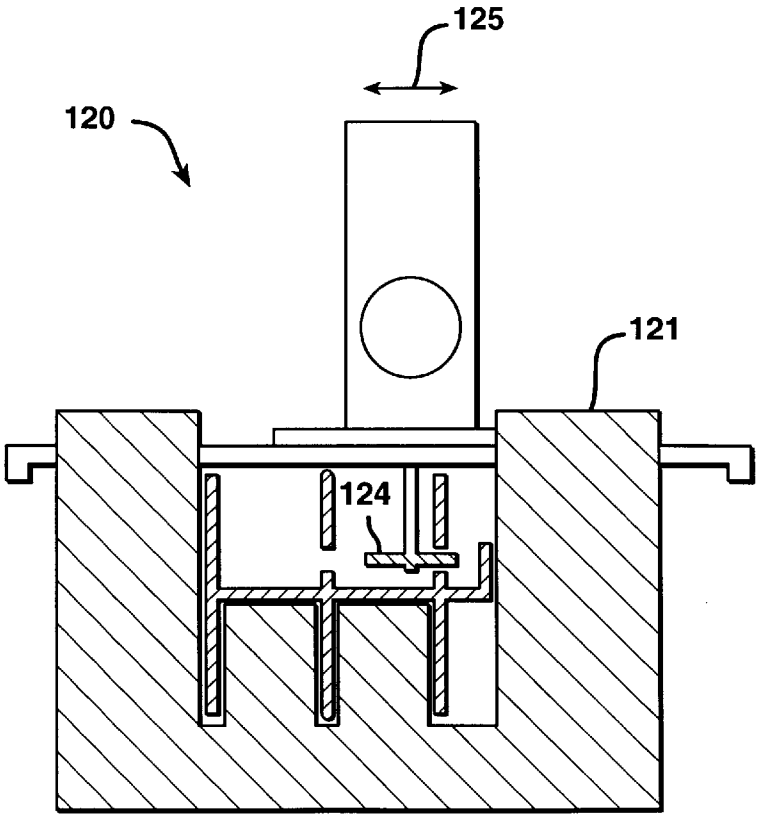
FIGS. 34A–34B are end views of the ridge weep hole router station.
Figure 34A:
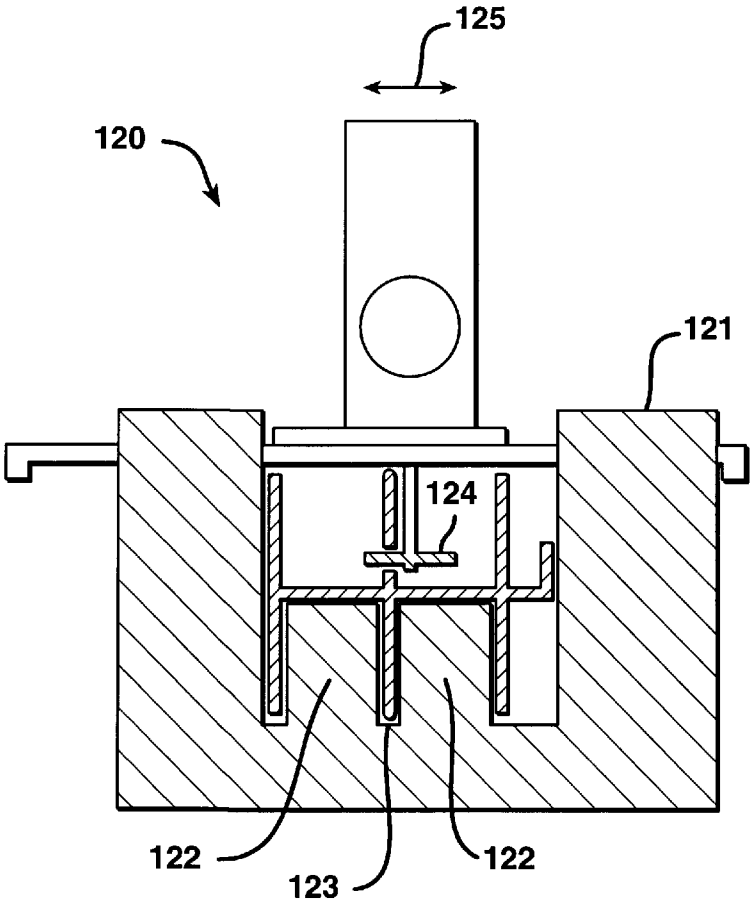

Weep holes are provided in the medial ridge and outer lateral ridge, i.e., the lateral ridge on the same side as and closest to the screen track, using a ridge weep hole router station 120. The station comprises a ridge weep hole guide 121 on which is mounted a conventional router. The ridge weep hole guide is shown in FIG. 34A and FIG. 34B. Its construction is conceptually similar to that of the screen track remover. For example, the router is mounted on a router shuttle plate capable of sliding a sufficient distance to effect the desired cut. The guide is depicted as being constructed of a single block of material, such as aluminum, but in actuality the skilled artisan will recognize that the guide is preferably and more easily constructed using multiple segments fastened together with conventional hardware. The ridge weep hole guide differs most substantially from the screen track remover in that the weep hole guide accepts a sill whereas the screen track remover was designed for guiding base profiles having a tubular space, such as the jamb post, corner post, or starter. The ridge weep hole guide therefore, has one and preferably two parallel spaced apart rails 122 and defining a groove 123 for receiving the medial ridge of the sill.

Further, the preferred cutting tool bit on the weep hole router is a Woodruff style cutter 124 rather than a straight tool bit as in the screen track remover. The Woodruff tool bit is designed for cutting holes in vertical "wall-like" structures such as the medial and outer lateral ridge of the sill.

With the router and tool bit positioned so as not to block passage of the sill through the guide, the sill is advanced to a point where the weep hole is desired. A series of guide rails support the sill from lateral forces imparted to it by the rotating cutting tool. The sill is held firmly in place by the operator. The router, having the Woodruff style cutting tool bit, is electrically powered. The shuttle plate to which the router is attached is then moved to the position shown in FIG. 34A to cut a weep hole in the medial ridge. Without removing the sill from the guide, a second weep hole is cut in the outer lateral ridge, i.e., the lateral ridge closest to the screen track, by moving the router along its shuttle path 125 to the position shown in FIG. 34B.

Figure 35B:
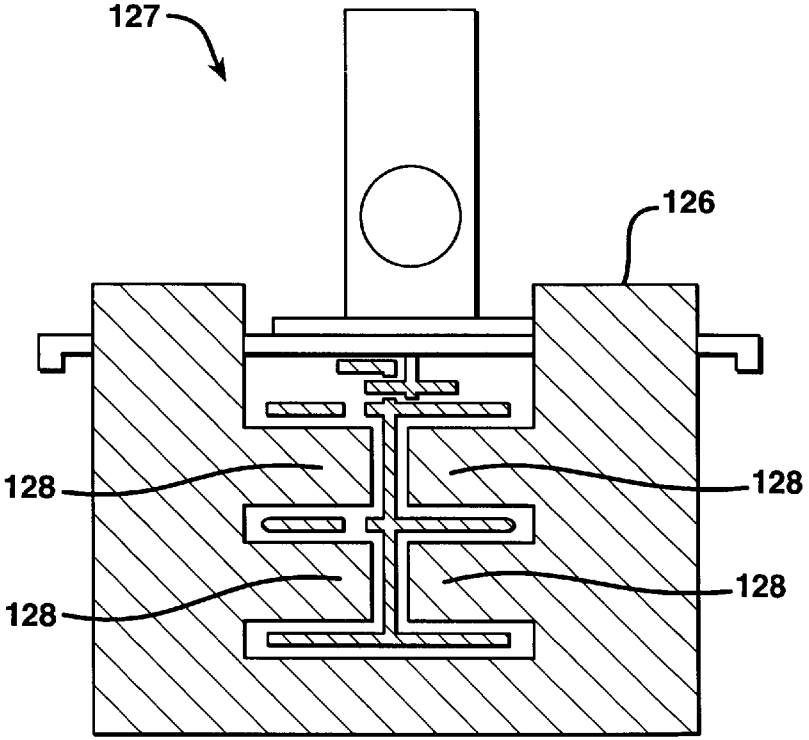
FIGS. 35A–35B are end views of the screen track extension weep hole router stattion.
Figure 35A:
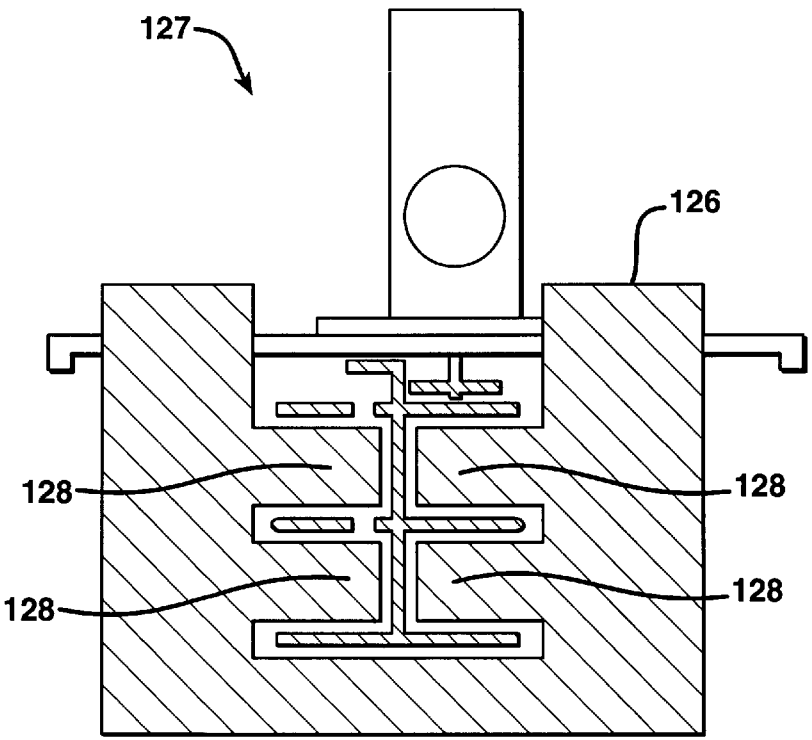
Figure 36:
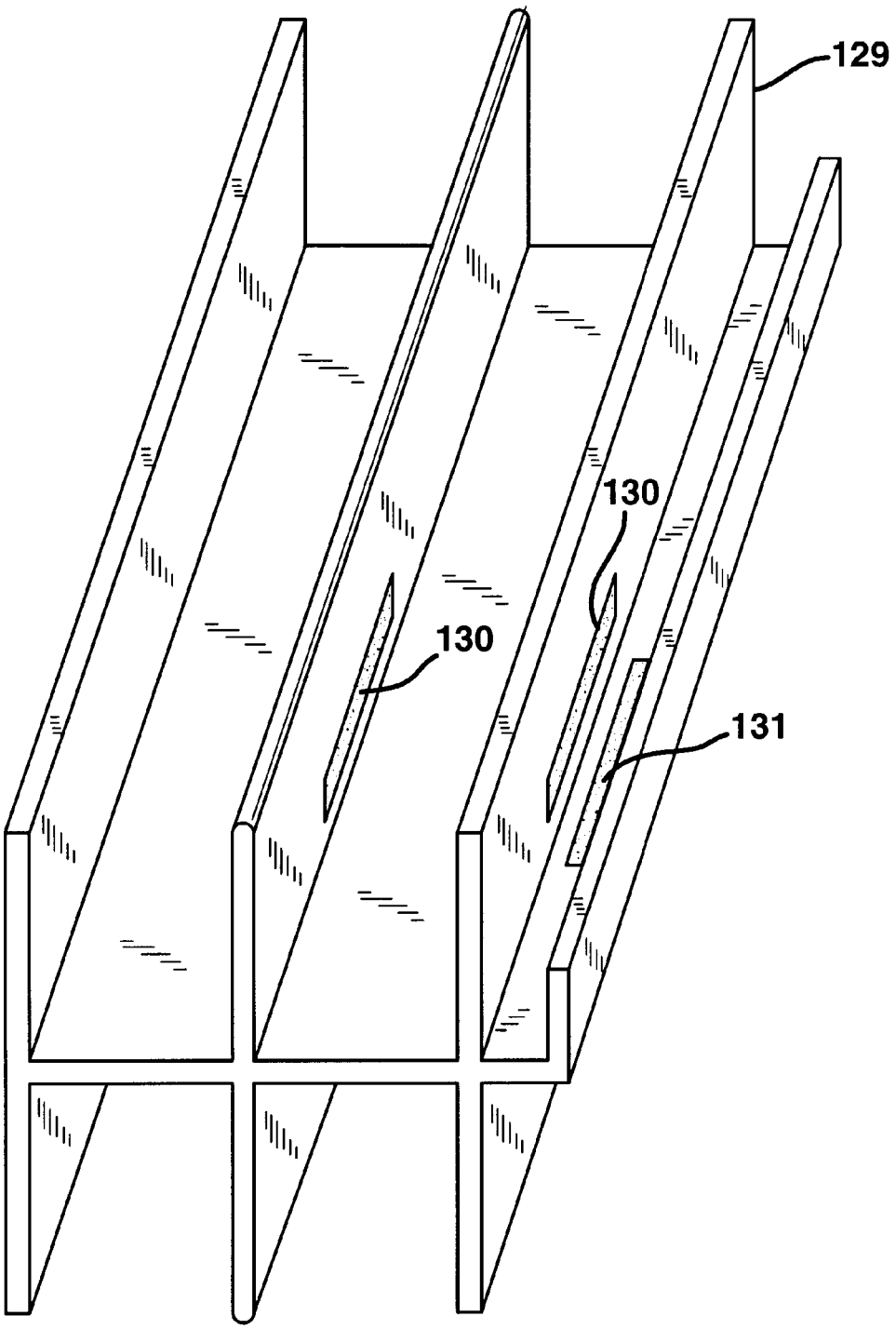
FIG. 36 is perspective view of a sill having weep holes.

The router is de-energized, the sill is removed from the ridge weep hole guide, and is inserted into the screen extension weep hole guide 126 of the screen extension weep hole router station 127 shown in FIG. 35A and FIG. 35B. Preferably, two pairs of horizontally opposed guide rails 128 stabilize the sill as an analogous motion and cutting process is carried out to place a weep hole in the riser portion of the screen track extension. The resulting weep hole-bearing sill 129 has two ridge weep holes 130 and one screen track extension weep hole 131 as shown in FIG. 36.

Figure 37:
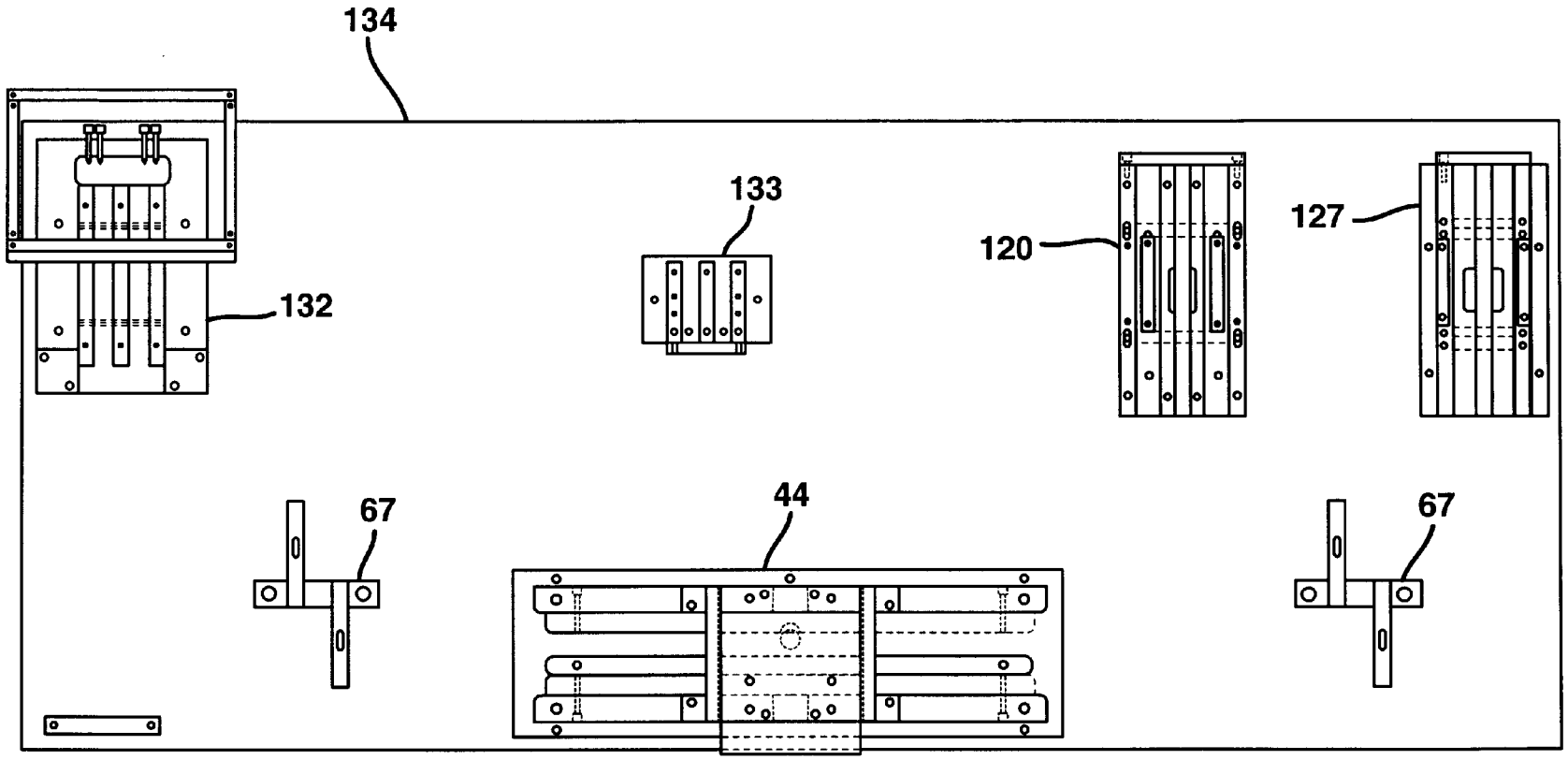
FIG. 37 is a plan view of a router station table.

As shown in FIG. 37, the screen track remover 44, stop jigs 67, ridge weep hole router station 120, and screen track weep hole router station 127 may most advantageously be securely mounted on a sturdy table or other substrate. Other fabrication stations, such as a window sash trimmer station 132 and a drill jig station 133, may also be securely mounted to the so-called "router table" 134.

Figure 38:
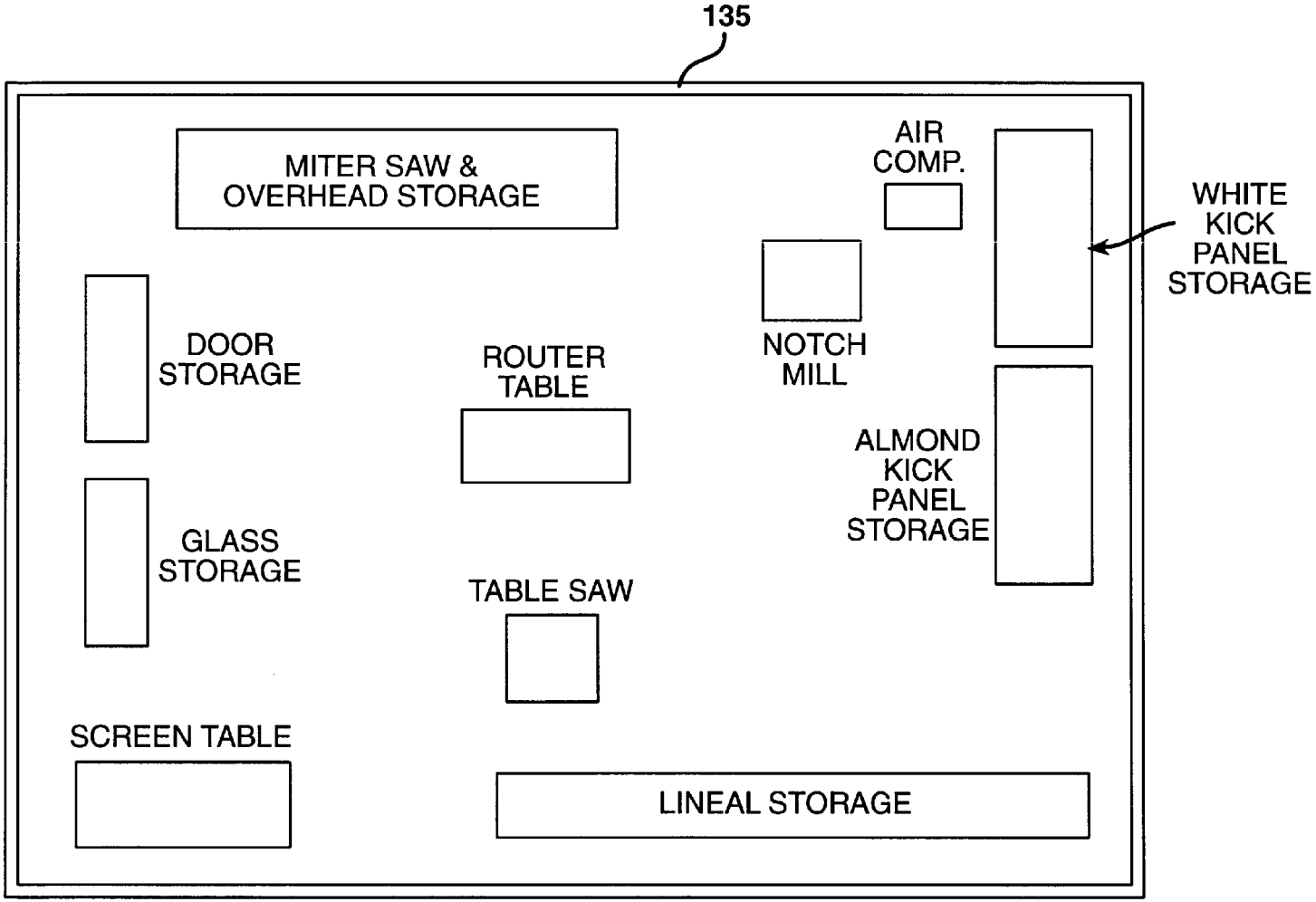
FIG. 38 is a plan view of a fabrication shop.

Together, as shown in FIG. 38, the notch mill machine 84 and router table 134 may form the core of a fabrication shop 135 for assembling the enclosure of the subject invention from a widely distributed manufacturing base rather than from one or a small number of centrally located factories. In addition to the router table including the screen track remover and weep hole stations, notch mill machine, and associated equipment, e.g., air compressor, the fabrication shop would further include a table saw, mitre saw, and various areas for storing glass panes, door assemblies, base profiles, kick panels, and roof panels.

An index of drawing reference numerals and the features they represent follows:

| | |
|---|---|
| 1. | Enclosure |
| 2. | Load bearing substrate |
| 3. | Existing structure |

-continued

| | |
|---|---|
| 4. | Kick plates |
| 5. | Framed windows |
| 6. | Framed screens |
| 7. | Door assembly |
| 8. | Notch mill stop |
| 9. | H beam roof members |
| 10. | Floor starter |
| 11. | Front header |
| 12. | Sills |
| 13. | Side header |
| 14. | Wall starter |
| 15. | Door jamb |
| 16. | Jamb post |
| 17. | Corner post |
| 18. | Gable end panels |
| 19. | Roof panels |
| 20. | Kick plate core |
| 21. | Kick place sheet |
| 22. | Kerf |
| 23. | Medial ridge |
| 24. | Outer lateral ridge |
| 24. | Inner lateral ridge |
| 25. | F-channel |
| 26. | Bottom sash, Header sash |
| 27. | Meeting rail - Male interlock |
| 28. | Meeting rail with female interlock |
| 29. | Sash handle & lift rail |
| 30. | Outer track |
| 31. | Inner track |
| 32. | Screen tracks |
| 33. | Light gauge aluminum decking |
| 34. | Insert |
| 35. | Foam injected roof panels |
| 36. | Jamb post base profile |
| 37. | Base starter |
| 38. | Base corner post |
| 39. | Base sill |
| 40. | Screen track extensions |
| 41. | Tubular space |
| 42. | Tube wall |
| 43. | Header channel |
| 44. | Screen track removal apparatus |
| 45. | Guide |
| 46. | Router |
| 47. | Router shuttle plate |
| 48. | Tool bit |
| 49. | Upper guide rails (Right) |
| 50. | Upper guide rails (Left) |
| 51. | Lower rail |
| 52. | Motion arrow |
| 53. | Riser portion |
| 54. | Shuttle plate support ledges |
| 55. | Shuttle plate support ledges |
| 56. | Table |
| 57. | Bolts |
| 58. | Shuttle stops (removable) |
| 59. | Shuttle stops (nonremovable) |
| 60. | Shuttle stop fastener |
| 61. | Guide wall |
| 62. | Guide wall |
| 63. | Router handle grip |
| 64. | Router handle grip |
| 65. | Detached portion |
| 66. | Direction of motion |
| 67. | Stop Jig |
| 68. | Left stop member |
| 69. | Right stop member |
| 70. | Jig body |
| 71. | Pinion fasteners |
| 72. | C-channel ends |
| 73. | C-channel ends |
| 74. | Router mounting fastener |
| 75. | Router mounting fastener |
| 76. | Lag bolts |
| 77. | Decking |
| 78. | Concrete anchors |
| 79. | Concrete slab |
| 80. | Insert fastener |
| 81. | Joist |
| 82. | Concave shape |

-continued

| | |
|---|---|
| 83. | L-bracket |
| 84. | Notch mill machine |
| 85. | Notch guide |
| 86. | Vertical clamp |
| 87. | Vertical-clamp |
| 88. | Side clamp |
| 89. | Notch guide base |
| 90. | Guide rail |
| 91. | Guide rail |
| 92. | Lowest blade |
| 93. | Notch blade |
| 94. | Lower paired blade |
| 95. | Upper paired blade |
| 96. | Air compressor |
| 97. | Rail fasteners |
| 98. | Rail support |
| 99. | Side clamp support |
| 100. | Top clamp support |
| 101. | Segment fasteners |
| 102. | Notch mill table |
| 103. | Piston |
| 104. | Power box |
| 105. | Far limit switch |
| 106. | Blade actuator |
| 107. | Near limit switch |
| 108. | Motor |
| 109. | Rods |
| 110. | Casing opening |
| 111. | Rod fasteners |
| 112. | Lower spacer |
| 113. | Upper spacer |
| 114. | Oblong opening |
| 115. | Exposed portion |
| 116. | Lowest cutting tip |
| 117. | Notch cutting tip |
| 118. | Lower paired cutting tip |
| 119. | Upper paired cutting tip |
| 120. | Ridge weep hole router station |
| 121. | Ridge weep hole router guide |
| 122. | Spaced apart rails |
| 123. | Groove |
| 124. | Woodruff cutter |
| 125. | Shuttle path |
| 126. | Screen track extension weep hole guide |
| 127. | Screen track extension weep hole router station |
| 128. | Rails |
| 129. | Sill with weep hole |
| 130. | Ridge weep hole |
| 131. | Screen track weep hole |
| 132. | Window sash trimmer station |
| 133. | Drill jig station |
| 134. | Router table |
| 135. | Fabrication shop |
| 136. | Alternative notch guide |
| 137. | Base groove |
| 138. | Base groove |
| 139. | Base groove |

What is claimed is:

1. A structural member comprising:

a hollow parallelipiped having a first exterior surface and a length; and a first inner ridge, a first outer ridge, and a first medial ridge between said first inner ridge and said first outer ridge, whereby each of said first ridges extends outwardly from said first exterior surface along the length thereof, whereby said ridges form a first pair of adjacent window tracks, and a first L-shaped extension extending outwardly from said parallelipiped, said first L-shaped extension being adjacent to said first outer ridge along the length thereof, whereby said first L-shaped extension forms a first screen track.

2. The structural member of claim 1 wherein the structural member comprises a plastic extrusion.

3. The structural member of claim 2 wherein said plastic comprises polyvinyl chloride.

4. The structural member of claim 1 wherein the medial ridge is located approximately mid-way between said first inner ridge and first outer ridge.

5. The structural member of claim 1 wherein the parallelipiped has a second exterior surface with a second inner ridge, second medial ridge, and second outer ridge, wherein each of said second ridges extends outwardly from said second exterior surface along said length thereof, whereby said second ridges form a second pair of adjacent window tracks.

6. The structural member of claim 5 wherein said second exterior surface is disposed at 90 degrees with respect to said first exterior surface.

7. The structural member of claim 5 wherein said second exterior surface is substantially parallel to said first exterior surface.

8. The structural member of claim 5 further comprising:

a second L-shaped extension extending outwardly from said parallelipiped, said second L-shaped extension being adjacent to said second outer ridge along the length thereof, whereby said second L-shaped extension forms a second screen track.

9. The structural member of claim 8 wherein said second exterior surface is disposed at 90 degrees with respect to said first exterior surface.

10. The structural member of claim 8 wherein said second exterior surface is substantially parallel to said first exterior surface.

11. The structural member of claim 1 further comprising a reinforcing insert positioned within said parallelipiped.

12. A joint of structural members comprising:

(a) a male structural member comprising a reinforced square-shaped parallelipiped having a first male member exterior surface and a male member length; and a first male member inner ridge, a first male member outer ridge, and a first male member medial ridge between said first male member ridge and said first male member outer ridge, whereby each of said first male member ridges extends outwardly from said first male member exterior surface along said length thereof, whereby said male member ridges form a first male member pair of adjacent window tracks and an end of said male member includes a groove;

(b) a female structural member comprising a reinforced square-shaped parallelipiped having a first female member exterior surface and a female member length; and a first female member inner ridge, a first female member outer ridge, and a first female member medial ridge between said first female member ridge and said first female member outer ridge, whereby each of said first female member ridges extends outwardly from said first female member exterior surface along said female member length thereof; and whereby said female member ridges form a first female member pair of adjacent window tracks, wherein an end of said male member is positioned within said first female member pair of adjacent window tracks and said female member medial ridge is received by said male member groove, and said male member is at a substantially right angle to the female member.

13.The joint of claim 12 further comprising fastening means for fastening said male and female members together, wherein said fastening means is located partially within a window track of said male member and partially within a window track of said female member.

14. A wall system of an enclosed structure, said wall system comprising (a) a floor starter mounted on a support substrate, said floor starter including a hollow square-shaped parallelipiped within which a floor starter reinforcing insert is positioned;

(a) a pair of spaced apart uprights, a lower end of each upright being joined to said floor starter;

(b) a sill having at least one sill window track adapted for receiving a framed window, said sill being joined to each of said uprights at opposite ends of said sill;

(c) a header having at least one header window track adapted for receiving said framed window, said header being joined to each of said uprights and adapted for supporting a roof: and (d) a kick plate partially received by said floor starter, uprights, and sill.

15. The wall system of claim 14 further comprising fasteners fastening said uprights to said floor starter.

16. The wall system of claim 15 wherein said fasteners are hidden from view by said kick plate and ridges.

17. The wall system of claim 14 further comprising screen tracks along portions of each of said uprights and sill, said screen tracks adapted for receiving framed screens.

18.The wall system of claim 14 wherein each of said floor starter, uprights, sill, and header comprises a polyvinyl chloride extrusion.

19.The wall system of claim 14 wherein each of said uprights includes a hollow square-shaped parallelipiped within which an upright reinforcing insert is positioned.

20. The wall system of claim 14 wherein each of said lower ends is received between lengthwise-running ridges of said floor starter, and a lengthwise-running medial ridge of said floor starter is received within grooves in said lower ends of said uprights.

21. The wall system of claim 14 further comprising at least one framed window positioned within said sill window track and said header window track.

22. The wall system of claim 14 wherein said sill includes a first sill window track and a second sill window track;

said header includes a first header window track and a second header window track;

a first framed window is positioned within said first sill window track and said first header window track; and a second framed window is positioned within said second sill window track and said second header window track.

23.The wall system of claim 22 wherein said first and second framed windows are adapted to slide along said window tracks.

* * * * *